US009100747B2

(12) United States Patent
Murata et al.

(10) Patent No.: US 9,100,747 B2
(45) Date of Patent: Aug. 4, 2015

(54) SIGNAL PROCESSING DEVICE AND SIGNAL PROCESSING METHOD

(75) Inventors: Yasunobu Murata, Tokyo (JP); Kohei Asada, Kanagawa (JP); Noriyuki Ozawa, Tokyo (JP)

(73) Assignee: Sony Corporation, Tokyo (JP)

( * ) Notice: Subject to any disclaimer, the term of this patent is extended or adjusted under 35 U.S.C. 154(b) by 919 days.

(21) Appl. No.: 13/262,006

(22) PCT Filed: Mar. 30, 2010

(86) PCT No.: PCT/JP2010/055691

§ 371 (c)(1),
(2), (4) Date: Sep. 29, 2011

(87) PCT Pub. No.: WO2010/116925

PCT Pub. Date: Oct. 14, 2010

(65) Prior Publication Data

US 2012/0033827 A1 Feb. 9, 2012

(30) Foreign Application Priority Data

Apr. 7, 2009 (JP) ..... 2009-093119

(51) Int. Cl.
*H04R 1/10* (2006.01)
*G10K 11/178* (2006.01)
(Continued)

(52) U.S. Cl.
CPC ..... *H04R 1/1083* (2013.01); *G10K 11/1782* (2013.01); *G10K 2210/1081* (2013.01);
(Continued)

(58) Field of Classification Search
CPC .... H04R 5/033; H04R 25/00; H04R 2225/41; H04R 2225/43; H04R 2225/49; G10K 2210/30351; G10K 2210/30391; G10K 2210/3053
USPC ..... 381/94.1–94.3, 71.11–71.12, 71.6, 93, 381/103, 106, 317, 320
See application file for complete search history.

(56) References Cited

U.S. PATENT DOCUMENTS 7,383,179 B2 * 6/2008 Alves et al. ..... 704/228
8,340,318 B2 * 12/2012 Copley et al. ..... 381/94.1
(Continued)

FOREIGN PATENT DOCUMENTS

JP 04-008099 A 1/1992
JP 07-287586 10/1995
(Continued)

OTHER PUBLICATIONS

International Search Report and Written Opinion mailed Jul. 20, 2010 in connection with International Application No. PCT/JP2010/055691, and English translation thereof.
(Continued)

*Primary Examiner* — Davetta W Goins
*Assistant Examiner* — Daniel Sellers
(74) *Attorney, Agent, or Firm* — Wolf, Greenfield & Sacks, P.C.

(57) ABSTRACT

A signal processing device includes a noise analysis unit for analyzing a frequency component of a noise signal obtained by converting a collected sound into an electrical signal, a plurality of filtering units for carrying out predetermined filtering operations on the noise signal on the basis of an analysis result, and an output control unit for temporally varying a synthesis rate of outputs of the plurality of filtering units according to a change in the analysis result of the noise analysis unit. When the analysis result of the noise analysis unit changes, one filtering unit starts a predetermined filtering operation by characteristics different from those of other filtering units that carry out predetermined filtering operations on the noise signal according to the change in the analysis result of the noise analysis unit.

10 Claims, 23 Drawing Sheets

(51) Int. Cl.
*H04R 5/033* (2006.01)
*H04R 25/00* (2006.01)

(52) U.S. Cl.
CPC ..... *G10K2210/3025* (2013.01); *G10K 2210/30391* (2013.01); *H04R 5/033* (2013.01); *H04R 25/00* (2013.01); *H04R 2225/43* (2013.01); *H04R 2460/01* (2013.01)

(56) References Cited

U.S. PATENT DOCUMENTS

| | | | | |
|---|---|---|---|---|
| 8,798,289 | B1 * | 8/2014 | Every et al. | 381/94.1 |
| 2008/0112569 | A1 | 5/2008 | Asada | |
| 2009/0034748 | A1 * | 2/2009 | Sibbald | 381/71.6 |

FOREIGN PATENT DOCUMENTS

| | | | |
|---|---|---|---|
| JP | 10-247087 | | 9/1998 |
| JP | 2000-059876 | A | 2/2000 |
| JP | 2000-112483 | A | 4/2000 |
| JP | 2008-122729 | | 6/2008 |
| WO | WO 2009/041012 | A1 | 4/2009 |

OTHER PUBLICATIONS

International Search Report and Written Opinion mailed Oct. 20, 2011 in connection with International Application No. PCT/JP2010/055691, and English translation thereof.

* cited by examiner

SIGNAL PROCESSING DEVICE AND SIGNAL PROCESSING METHOD

CROSS REFERENCES TO RELATED APPLICATIONS

This application claims the priority benefit under 35 U.S.C. §365 as a national application of international application No. PCT/JP2010/055691, filed Mar. 30, 2010, and of Japanese patent application No. 2009-093119, filed in the Japan Patent Office on Apr. 7, 2009, to which the international application claims priority, which is hereby incorporated by reference to the maximum extent allowable by law.

TECHNICAL FIELD

The present invention relates to a signal processing device and a signal processing method.

BACKGROUND ART

Noise cancelling systems are known to provide good music reproduction environments for listeners (users) when they listen to music and the like through earphones, headphones, and the like by reducing (cancelling) noise of external environments. In the noise cancelling systems of the related art, a primary process of reducing noise is an analog process. However, noise cancelling systems based on digital processes have also recently been developed, and headphones equipped with the noise cancelling systems based on digital processes have been commercialized and are available in the marketplace. The noise cancelling systems based on the digital processes are equipped with a plurality of noise cancelling modes of the digital processes as well as high noise cancelling performance based on the digital processes. A listener can selectively use an optimal mode according to noise because the plurality of noise cancelling modes are provided (for example, Patent Literature 1).

Furthermore, some headphones equipped with the noise cancelling systems are provided with a function of analyzing a state of ambient noise when the user simply presses a button and automatically selecting an optimal noise cancelling mode (an optimal-mode selection function). If the optimal-mode selection function is executed in the headphones, the headphones first stop an operation of outputting music or the like, and also stop a noise cancelling function. The headphones collect a noise sound from a microphone provided on their inner or outer side, analyze the collected sound, and select an optimal mode based on an analysis result. If the optimal mode is selected, the headphones resume the noise cancelling function by switching to the selected mode, and resume the operation of outputting music or the like.

CITATION LIST

Patent Literature

Patent Literature 1: JP 2008-122729A

SUMMARY OF INVENTION

Technical Problem

However, the headphones equipped with the optimal-mode selection function of the related art as described above have a problem in that the output operation should be stopped while the noise sound is analyzed. The noise cancelling function should be stopped once for analysis, despite the user's desire to enjoy music in a comfortable environment by reducing a noise environment. Accordingly, the user may experience discomfort during noise analysis.

In the headphones equipped with the optimal-mode selection function of the related art as described above, there is a problem in that the user himself/herself should execute the optimal-mode selection function when a state of ambient noise is varied. For example, when a user gets on or off an electric train, a noise cancelling function corresponding to a noise state fails if the user forgets a manipulation, regardless of a change in the state of ambient noise. Because the user himself/herself should execute the optimal-mode selection function, an optimal mode specialized and tuned for a different noise environment may not be utilized when the user sets the optimal-mode selection function to be disabled.

The present invention has been made in view of the above-described problem, and an object of the invention is to provide a novel and improved signal processing device and method that can enable a user to listen to music or the like constantly in a good acoustic environment by constantly analyzing a noise state and automatically performing switching to an optimal mode when a state of ambient noise is varied.

Solution to Problem

According to an aspect of the present invention in order to achieve the above-mentioned object, there is provided a signal processing device including a noise analysis unit for analyzing a frequency component of a noise signal obtained by converting a collected sound into an electrical signal, a plurality of filtering units for carrying out predetermined filtering operations on the noise signal on the basis of an analysis result of the noise analysis unit, and an output control unit for temporally varying and outputting a synthesis rate of outputs of the plurality of filtering units according to a change in the analysis result of the noise analysis unit, wherein one filtering unit starts a predetermined filtering operation by characteristics different from those of other filtering units that carry out predetermined filtering operations on the noise signal according to the change in the analysis result of the noise analysis unit, and the output control unit temporally varies the synthesis rate of the outputs of the other filtering units and the one filtering unit according to the change in the analysis result of the noise analysis unit and performs switching from the output of the other filtering units to the output of the one filtering unit.

According to this configuration, the noise analysis unit analyzes a frequency component of a noise signal obtained by converting a collected sound into an electrical signal, the plurality of filtering units carry out predetermined filtering operations on the noise signal on the basis of an analysis result of the noise analysis unit, and the output control unit temporally varies and outputs a synthesis rate of outputs of the plurality of filtering units according to a change in the analysis result of the noise analysis unit. One filtering unit of the plurality of filtering units starts a predetermined filtering operation by characteristics different from those of other filtering units that carry out predetermined filtering operations on the noise signal according to the change in the analysis result of the noise analysis unit, and the output control unit temporally varies the synthesis rate of the outputs of the other filtering units and the one filtering unit according to the change in the analysis result of the noise analysis unit and performs switching from the output of the other filtering units. As a result, a user can listen to music or the like constantly in a good acoustic environment by switching an output from a filtering unit so that a filtering operation by a filter having appropriate characteristics is carried out according to a change in an analysis result of the noise analysis unit, that is, according to a change in a state of ambient noise.

The characteristics of the other filtering units may be set to be the same as those of the one filtering unit when an output of the output control unit is switched from the output of the other filtering units to the output of the one filtering unit.

The output control unit may start to switch the output from the other filtering units to the one filtering unit if the noise analysis unit makes a predetermined number of continuous determinations that a filtering operation by characteristics different from current characteristics is preferable as the analysis result of the noise analysis unit.

The signal processing device may further include an equalizer unit for executing an equalization process for an audio signal on the basis of the analysis result of the noise analysis unit and outputting an execution result, wherein an output of the equalizer unit is superimposed on an output of the output control unit. The signal processing device may include a signal processing unit including the filtering unit and the equalizer unit.

One main filtering unit of the plurality of filtering units may constantly operate, and the other filtering units may operate only when the analysis result of the noise analysis unit changes and otherwise may not operate.

The signal processing device may include a signal processing unit, which includes the noise analysis unit when the noise signal is analyzed, includes the one filtering unit when a predetermined filtering operation is carried out on the noise signal, and is configured so that the noise analysis unit and the filtering unit are switchable.

The one filtering unit may start a predetermined filtering operation by characteristics different from those of the other filtering units when the analysis result of the noise analysis unit changes and the same analysis result is continuously generated a plurality of times after the change.

According to another aspect of the present invention in order to achieve the above-mentioned object, there is provided a signal processing method including a noise analysis step of analyzing a frequency component of a noise signal obtained by converting a collected sound into an electrical signal, a first filtering step of carrying out a predetermined filtering operation on the noise signal on the basis of an analysis result of the noise analysis step, a second filtering step of carrying out a predetermined filtering operation on the noise signal by characteristics different from those of the first filtering step on the basis of the analysis result of the noise analysis step, and an output control step of temporally varying a synthesis rate of outputs of the first filtering step and the second filtering step according to a change in the analysis result of the noise analysis step and performing switching from the output of the first filtering step to the output of the second filtering step to output a switching result.

According to another aspect of the present invention in order to achieve the above-mentioned object, there is provided a computer program for causing a computer to execute a noise analysis step of analyzing a frequency component of a noise signal obtained by converting a collected sound into an electrical signal, a first filtering step of carrying out a predetermined filtering operation on the noise signal on the basis of an analysis result of the noise analysis step, a second filtering step of carrying out a predetermined filtering operation on the noise signal by characteristics different from those of the first filtering step on the basis of the analysis result of the noise analysis step, and an output control step of temporally varying a synthesis rate of outputs of the first filtering step and the second filtering step according to a change in the analysis result of the noise analysis step and performing switching from the output of the first filtering step to the output of the second filtering step to output a switching result.

Advantageous Effects of Invention

According to the present invention as described above, the signal processing device and method can enable a user to listen to music or the like constantly in a good acoustic environment by constantly analyzing a noise state and automatically performing switching to an optimal mode when a state of ambient noise is varied.

DESCRIPTION OF EMBODIMENTS

Hereinafter, preferred embodiments of the present invention will be described in detail with reference to the appended drawings. Note that, in this specification and the drawings, elements that have substantially the same function and structure are denoted with the same reference signs, and repeated explanation is omitted.

Preferred embodiments of the present invention will be described in detail according to the following order.

<1. First Embodiment>

[1-1. Example of External Appearance of Headphones]

[1-2. Example of External Appearance of Headphones]

[1-3. Functional Configuration of Signal Processing Unit]

[1-4. Operation of Signal Processing Unit]

[1-5. Configuration of Modified Example of Signal Processing Unit]

[1-6. Operation of Modified Example of Signal Processing Unit]

<2. Second Embodiment>

[2-1. Configuration of Signal Processing Unit]

[2-2. Operation of Signal Processing Unit]

<3. Third Embodiment>

[3-1. Configuration of Signal Processing Unit]

[3-2. Operation of Signal Processing Unit]

[3-3. Example of Configuration of Noise Analysis unit]

<4. Fourth Embodiment>

[4-1. Configuration of Signal Processing Unit]

[4-2. Operation of Signal Processing Unit]

<5. Fifth Embodiment>

[5-1. Configuration of Headphones]

<6. Others>

<7. Summary>

<1. First Embodiment>

[1-1. Example of External Appearance of Headphones]

A signal processing device according to each embodiment of the present invention can be implemented in various forms. For example, the signal processing device may be implemented, for example, as headphones such as outer ear headphones, inner ear headphones, earphones, or a headset. Other examples of the signal processing device are, for example, a mobile phone, a portable player, a computer, a personal data assistance (PDA), and the like, which provide an audio signal to the above-described headphones. If the signal processing device is provided in a terminal or the like, the signal processing device can be implemented as a DSP of the terminal. Furthermore, the signal processing device according to each embodiment of the present invention can also be implemented as a hearing aid used to facilitate the hearing of voices or sounds of other persons. That is, each embodiment of the present invention can be implemented as various devices or terminals or the like capable of providing an audio signal or the like to the user. However, an example in which the signal processing device is implemented as headphones 1 will be described hereinafter to facilitate the understanding of the signal processing device according to each embodiment of the present invention.

Figure 1:
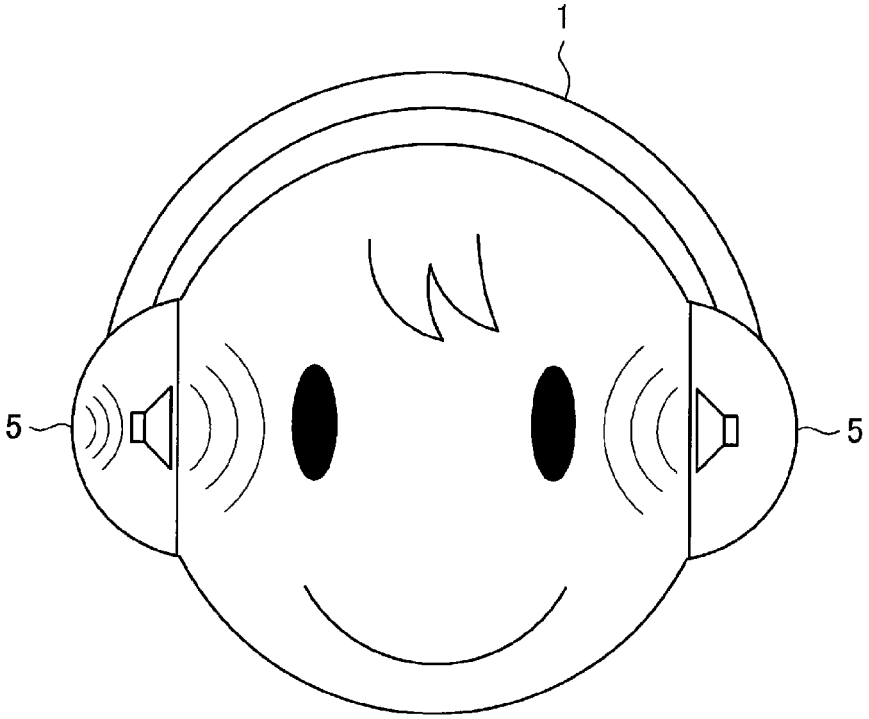
FIG. 1 is an illustrative diagram showing an example of an external appearance of headphones according to a first embodiment of the present invention.

FIG. 1 is an illustrative diagram showing an example of an external appearance of headphones according to the first embodiment of the present invention. Hereinafter, the external appearance of the headphones according to the first embodiment of the present invention will be described using FIG. 1.

Like normal headphones or the like, the headphones 1 according to the first embodiment of the present invention can acquire an audio signal from an external music reproduction device or the like and provide the user with the audio signal as an actual sound. Audio content expressed by the audio signal includes, for example, various types of music, a radio broadcast, a television broadcast, educational materials such as English conversation, entertainment content such as storytelling, a game sound, a moving picture sound, an operation sound of a computer, and the like, and is not particularly limited.

The headphones 1 shown in FIG. 1 include a noise cancelling system that provides the user with a good music reproduction environment by reducing noise of an external environment. In order to reduce the noise of the external environment, the headphones 1 include a microphone for collecting a noise sound of the external environment on an outer or inner side of a housing unit 5.

The noise cancelling system included in the headphones 1 performs a process of generating a noise cancelling signal for reducing noise (hereinafter, referred to as a "noise cancelling process") in a digital process. Because the noise cancelling process is executed in the digital process, the headphones 1 can be equipped with noise cancelling modes according to various external environments. Various external environments include, for example, a normal outdoor environment, an inside of an electric train, an inside of an airplane, and the like. The headphones 1 are equipped with a plurality of noise cancelling modes, so that the user can switch the mode according to the external environment and noise can be effectively reduced according to the external environment.

If there are the plurality of noise cancelling modes as described above, it is necessary for the user to select one mode from the plurality of modes. Thus, when there are a number of noise cancelling modes for adaptation to various external environments, the manipulation of the user may be complex and it may be difficult for the user to determine which mode should be selected.

Accordingly, some headphones equipped with the noise cancelling system are provided with a function of analyzing a state of ambient noise when the user simply presses a button and automatically selecting an optimal noise cancelling mode (optimal-mode selection function), as described above. However, the noise cancelling system equipped with the optimal-mode selection function of the related art as described above have a problem in that an output operation should be stopped while the noise sound is analyzed. Furthermore, the noise cancelling system equipped with the optimal-mode selection function of the related art has a problem in that the user himself/herself should execute the optimal-mode selection function when a state of ambient noise is varied.

The noise cancelling system included in the headphones 1 according to this embodiment analyzes a state of ambient noise constantly while the user executes the noise cancelling function, and automatically selects a mode corresponding to the state of ambient noise. Hereinafter, a function of automatically selecting the mode corresponding to the state of ambient noise is also referred to as a "full automatic optimal-mode selection function." In a state in which the full automatic optimal-mode selection function is executed, the noise cancelling system automatically selects the mode corresponding to the state of ambient noise, and executes a noise cancelling process based on the mode. It is possible to provide audio content to the user in a sate in which noise is reduced even when a noise state is varied by executing the noise cancelling process based on the automatically selected mode.

In order to execute the full automatic optimal-mode selection function, a microphone for collecting a sound of noise is necessary. The microphone may be provided on an inner or outer portion of a housing of the headphones. If the microphone is provided on the outer portion of the housing, it may be directly provided on an outer side of the housing, or may be provided in a position other than the housing, for example, a band portion connecting left and right housings of the headphones, or a control box for adjusting a volume or the like of the headphones. However, it is preferable to provide the microphone in a position close to the ear so as to collect a sound of noise of the position close to the ear. The number of microphones for collecting a sound of noise may be 1 or 2. However, in consideration of the position of the microphone mounted on the headphones and the fact that general noise normally exists in a substantially low band, only one microphone may be provided.

It is preferable to use a DSP and other processors having a function of executing the noise cancelling process at a high speed so as to execute the full automatic optimal-mode selection function. In the headphones having the full automatic optimal-mode selection function, a sufficient processing speed to constantly execute the analysis of noise is obtained without interrupting a signal process and a noise cancelling process for an audio signal output from the music reproduction device connected to the headphones. The headphones 1 according to this embodiment execute the signal process and the noise cancelling process for the audio signal by one, two, or more DSPs. If the processes are executed by the two or more DSPs, the DSPs may be identical or different. If the different DSPs are used, DSPs specialized for the noise cancelling process may be used. When this configuration is provided, it is possible to simultaneously execute a process of analyzing a noise sound collected by the microphone in addition to the signal process and the noise cancelling process for the audio signal output from the music reproduction device connected to the headphones.

In the noise cancelling process based on the digital process, it is possible to implement a function of providing the plurality of noise cancelling modes using a processor such as a DSP having necessary and sufficient performance and selecting an optimal mode from among the noise cancelling modes. However, there is a problem when switching from a certain mode to another mode is performed only if the optimal mode is simply selected. The problem is that abnormal noise accompanying the mode switching occurs. If the abnormal noise occurs every time an external environment is varied and a mode accompanying the variation is automatically switched, the user wearing the headphones may experience discomfort.

This embodiment is characterized by cross-fading a signal (noise cancelling signal) for eliminating a noise sound generated by the noise cancelling process due to a mode before/after switching when the noise cancelling mode is switched. It is possible to prevent the occurrence of abnormal noise accompanying a mode change and provide the user with a comfortable acoustic environment by cross-fading the noise cancelling signal.

The external appearance of the headphones according to the first embodiment of the present invention has been described above. Next, a functional configuration of the headphones according to the first embodiment of the present invention will be described.

[1-2. Example of External Appearance of Headphones]

Figure 2:
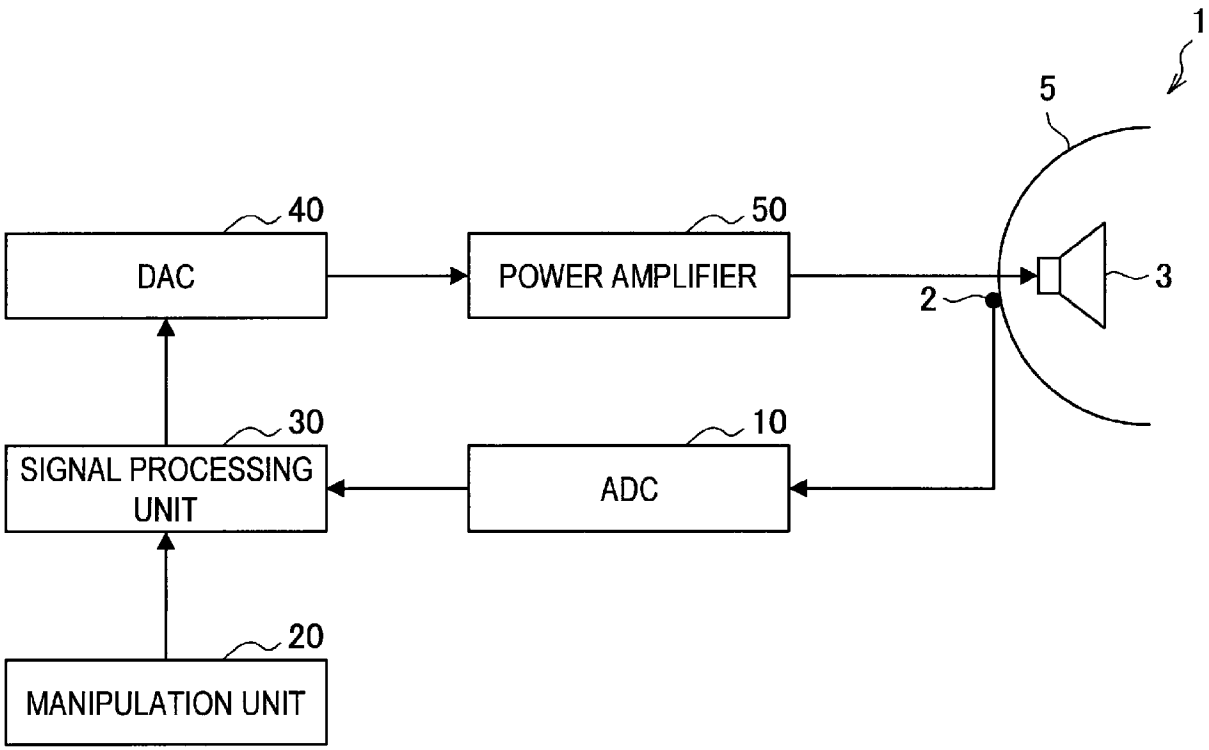
FIG. 2 is an illustrative diagram illustrating a functional configuration of headphones 1 according to the first embodiment of the present invention.

FIG. 2 is an illustrative diagram illustrating a functional configuration of the headphones 1 according to the first embodiment of the present invention. Hereinafter, the functional configuration of the headphones 1 according to the first embodiment of the present invention will be described using FIG. 2.

FIG. 2 shows the functional configuration of the headphones 1 including the noise cancelling system that cancels noise in a feedforward type. The feedforward type is a type of collecting a sound of noise in a position close to the ear, analyzing the collected sound, predicting a noise waveform in an eardrum position of the user, and generating a signal (anti-phase waveform) for eliminating the noise. As shown in FIG. 2, the headphones 1 according to the first embodiment of the present invention include a microphone 2, a speaker 3, an analog/digital converter (ADC) 10, a manipulation unit 20, a signal processing unit 30, a digital/analog converter (DAC) 40, and a power amplifier 50.

The microphone 2 provided in a position close to the ear of the user collects a sound of the position close to the ear of the user. Accordingly, the microphone 2 collects a sound of external noise, which reaches the ear. As the cause of noise occurring inside the housing unit 5 of the headphones 1, for example, an external noise sound source is leaked as a sound pressure, for example, from a gap such as an ear pad of the housing unit 5, or the housing of the headphones 1 is vibrated by receiving the sound pressure of the noise sound source and the vibration is transferred to the inside of the housing unit 5.

The speaker 3 for outputting an audio outputs an audio based on an audio signal transferred from the music reproduction device connected to the headphones 1. The headphones 1 generate a signal (noise cancelling signal) having a characteristic of eliminating an external noise component from a noise signal obtained by collecting a sound by the microphone 2, synthesize the generated signal with an audio signal transferred from the music reproduction device connected to the headphones 1, and output a synthesis result from the speaker 3. As described above, because an optimal noise cancelling signal is predicted from the sound collected by the microphone 2 and output from the speaker 3, this type is referred to as the feedforward type.

The ADC 10 converts a noise signal obtained as a result of sound collection by the microphone 2 into a digital signal. The noise signal converted into the digital signal by the ADC 10 is output to the signal processing unit 30.

The manipulation unit 20 is designed to receive a manipulation of the user on the headphones 1. The manipulation of the user on the headphones may be, for example, power on/off of the headphones 1, adjustment of a volume of a sound output from the speaker 3, and on/off of the noise cancelling function. Furthermore, the manipulation of the user on the headphones may be selection of the noise cancelling mode in which the noise cancelling function is valid, on/off of the full automatic optimal-mode selection function, or the like. A signal generated by manipulating the manipulation unit 20 is transferred, for example, to a microcomputer (not shown), and is transferred from the microcomputer to the signal processing unit 30, if necessary.

The signal processing unit 30 processes the noise signal converted into the digital signal by the ADC 10. The signal processing unit 30 analyzes the noise signal and generates a noise cancelling signal that eliminates the noise signal. An audio signal transferred from the music reproduction device connected to the headphones 1 is also input to the signal processing unit 30. The signal processing unit 30 also processes the input audio signal. The signal processing unit 30 is constituted, for example, by a plurality of DSPs.

The DAC 40 converts a signal output from the signal processing unit 30 into an analog signal. The signal converted into the analog signal by the DAC 40 is output to the power amplifier 50.

The power amplifier 50 amplifies the signal converted into the analog signal by the DAC 40 and outputs the amplified signal. The signal amplified by the power amplifier 50 is output to the speaker 3. The speaker 3 is configured to output an audio signaled by a vibration plate (not shown) in response to the signal supplied from the power amplifier 50.

The functional configuration of the headphones 1 according to the first embodiment of the present invention has been described above using FIG. 2. Next, a configuration of the signal processing unit 30 according to the first embodiment of the present invention will be described.

[1-3. Functional Configuration of Signal Processing Unit]

Figure 3:
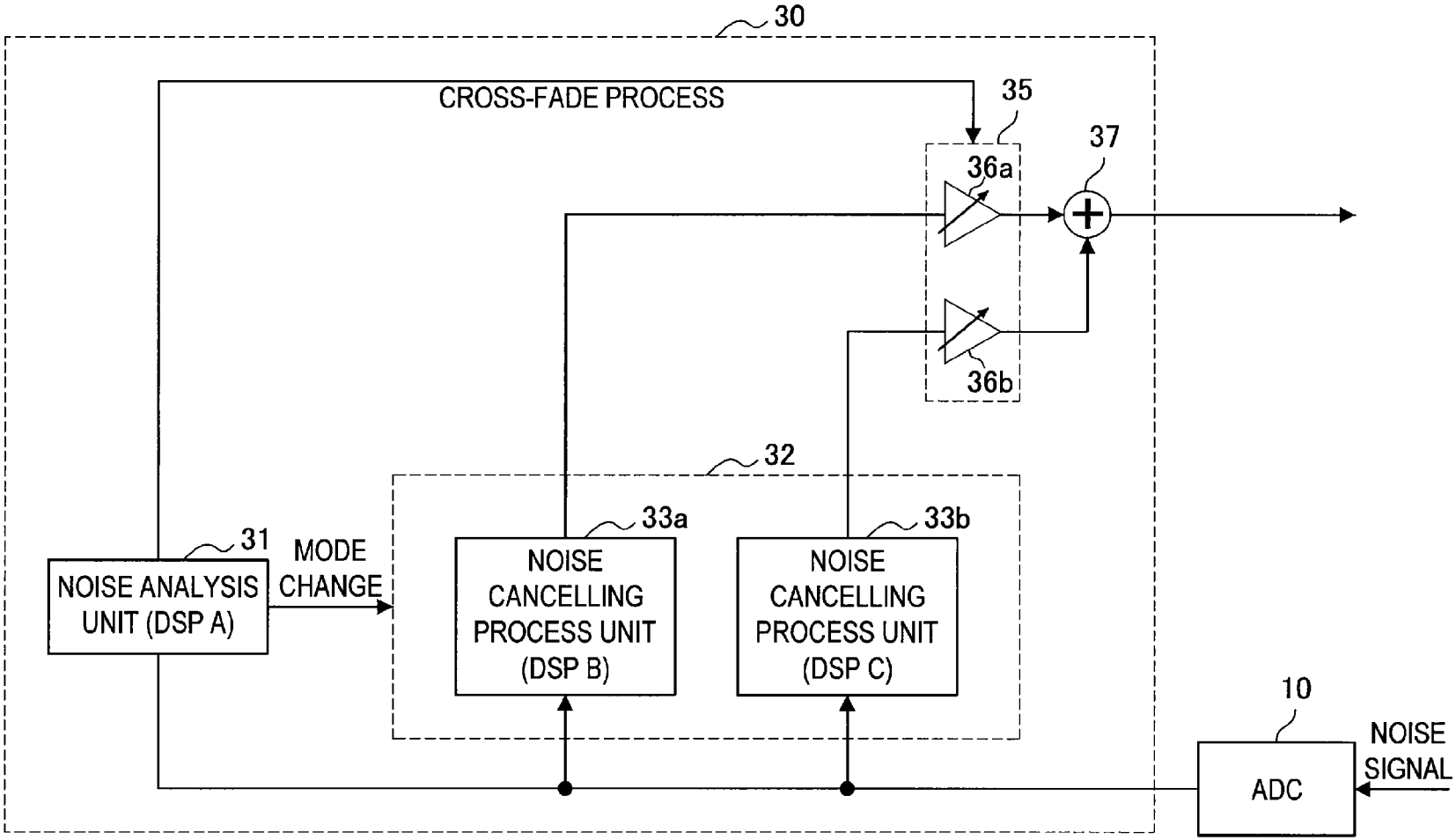
FIG. 3 is an illustrative diagram showing a configuration of a signal processing unit 30 according to the first embodiment of the present invention.

FIG. 3 is an illustrative diagram showing the configuration of the signal processing unit 30 according to the first embodiment of the present invention. FIG. 3 also shows the ADC 10 in conjunction with the signal processing unit 30. Hereinafter, the configuration of the signal processing unit 30 according to one embodiment of the present invention will be described using FIG. 3.

As shown in FIG. 3, the signal processing unit 30 according to the first embodiment of the present invention includes a noise analysis unit 31, a noise cancelling unit 32, a cross-fade unit 35, and an addition unit 37.

The noise analysis unit 31 executes a process of analyzing the noise signal converted into the digital signal by the ADC 10. The analysis process of the noise analysis unit 31 is constantly executed at a predetermined interval while the full automatic optimal-mode selection function is valid. The noise analysis unit 31 executes a frequency characteristic analysis of a noise signal by performing band dividing of the noise signal or the like, for example, based on a fast Fourier transform (FFT) or a band pass filter (BPF). On the basis of the result of frequency characteristic analysis, the noise analysis unit 31 selects an optimal noise cancelling mode, and instructs the noise cancelling unit 32 to execute the noise cancelling process in the noise cancelling mode.

The process of analyzing the noise signal by the noise analysis unit 31 may be executed by a DSP. In this embodiment, the DSP for executing the process of analyzing the noise signal by the noise analysis unit 31 is designated as a DSP A.

The noise cancelling unit 32 generates a signal for eliminating external noise reaching the ear of the user wearing the headphones 1 from the noise signal converted into the digital signal by the ADC 10. Specifically, the noise cancelling unit 32 generates a signal for eliminating external noise reaching the ear of the user wearing the headphones 1 by performing a predetermined filtering operation on the noise signal converted into the digital signal by the ADC 10. The noise cancelling unit 32 includes noise cancelling process units 33*a* and 33*b*.

The noise cancelling process units 33*a* and 33*b* are an example of filtering units of the present invention. Each of the noise cancelling process units 33*a* and 33*b* generates a signal for eliminating external noise reaching the ear of the user wearing the headphones 1 by performing a predetermined digital filtering operation on the noise signal converted into the digital signal by the ADC 10. The noise cancelling process units 33*a* and 33*b* may be constituted, for example, by a finite impulse response (FIR) filter or an infinite impulse response (IIR) filter.

Filtering operations by the noise cancelling process units 33*a* and 33*b* may be executed by DSPs. In this embodiment, the DSP for carrying out the filtering operation by the noise cancelling process unit 33*a* is designated as a DSP B, and the DSP for carrying out the filtering operation by the noise cancelling process unit 33*b* is designated as a DSP C.

In the noise cancelling unit 32, either the DSP B or the DSP C is in operation if a normal noise cancelling process is in execution. If it is necessary to switch the mode as a result of an analysis process for the noise signal by the noise analysis unit 31, a new mode is set for a DSP that is not in operation. By switching from a DSP currently in operation to the DSP in which the new mode is set, the noise cancelling unit 32 implements the switching of the noise cancelling mode.

Figure 4:
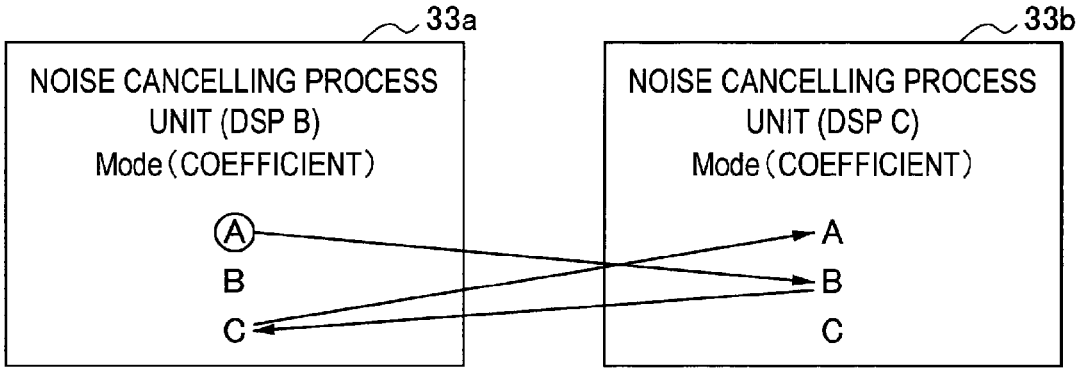
FIG. 4 is an illustrative diagram showing an example of coefficients retained by a noise cancelling process unit.

For the noise cancelling process units 33*a* and 33*b*, a filter configuration or a filter characteristic is set to be variable according to an optimal noise cancelling mode selected by the noise analysis unit 31. In this embodiment, coefficients corresponding to individual noise cancelling modes are pre-retained in the noise cancelling process units 33*a* and 33*b*. FIG. 4 is an illustrative diagram showing an example in which the noise cancelling process units 33*a* and 33*b* retain coefficients. In the example shown in FIG. 4, the noise cancelling process units 33*a* and 33*b* respectively retain coefficients A, B, and C corresponding to identical noise cancelling modes. In this embodiment, a noise cancelling process is executed by switching a coefficient between the noise cancelling process unit 33*a* and the noise cancelling process unit 33*b*. It is possible to omit the effort of newly writing coefficients to the noise cancelling process units 33*a* and 33*b* by providing in advance the same coefficients in the noise cancelling process units 33*a* and 33*b* as described above.

Figure 5:
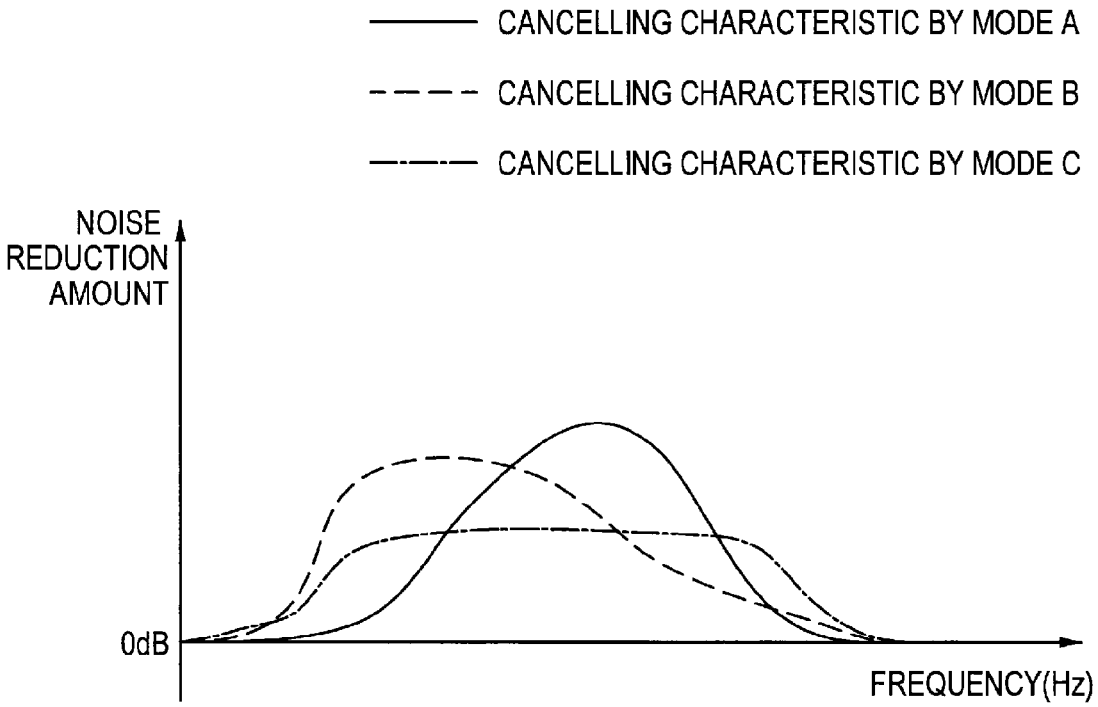
FIG. 5 is an illustrative diagram showing an example of noise reduction characteristics of each noise cancelling mode.

FIG. 5 is an illustrative diagram showing an example of noise reduction characteristics of each noise cancelling mode capable of being set in the headphones 1 according to the first embodiment of the present invention. In FIG. 5, an example of noise reduction characteristics of modes A, B, and C of FIG. 4 is shown. As described above, the noise cancelling modes have different noise reduction characteristics.

The coefficients for implementing the above-described noise reduction characteristics are pre-retained in the noise cancelling process units 33*a* and 33*b*.

The cross-fade unit 35 is an example of an output control unit of the present invention. When the noise cancelling mode is switched, the cross-fade unit 35 is designed to cross-fade outputs of the noise cancelling process units 33*a* and 33*b* in response to an instruction from the noise analysis unit 31. The cross-fade unit 35 includes multiplication units 36*a* and 36*b*. The multiplication units 36*a* and 36*b* respectively multiply outputs of the noise cancelling process units 33*a* and 33*b* by time-variant coefficients (gains) in response to an instruction from the noise analysis unit 31. Data multiplied by the multiplication units 36*a* and 36*b* is output to the addition unit 37.

The addition unit 37 adds outputs of the multiplication units 36*a* and 36*b* and outputs an addition result. The output of the addition unit 37 becomes a noise cancelling signal to be output to the DAC 40.

The configuration of the signal processing unit 30 according to the first embodiment of the present invention has been described above. Next, an operation of the signal processing unit 30 according to the first embodiment of the present invention will be described.

[1-4. Operation of Signal Processing Unit]

Figure 6:
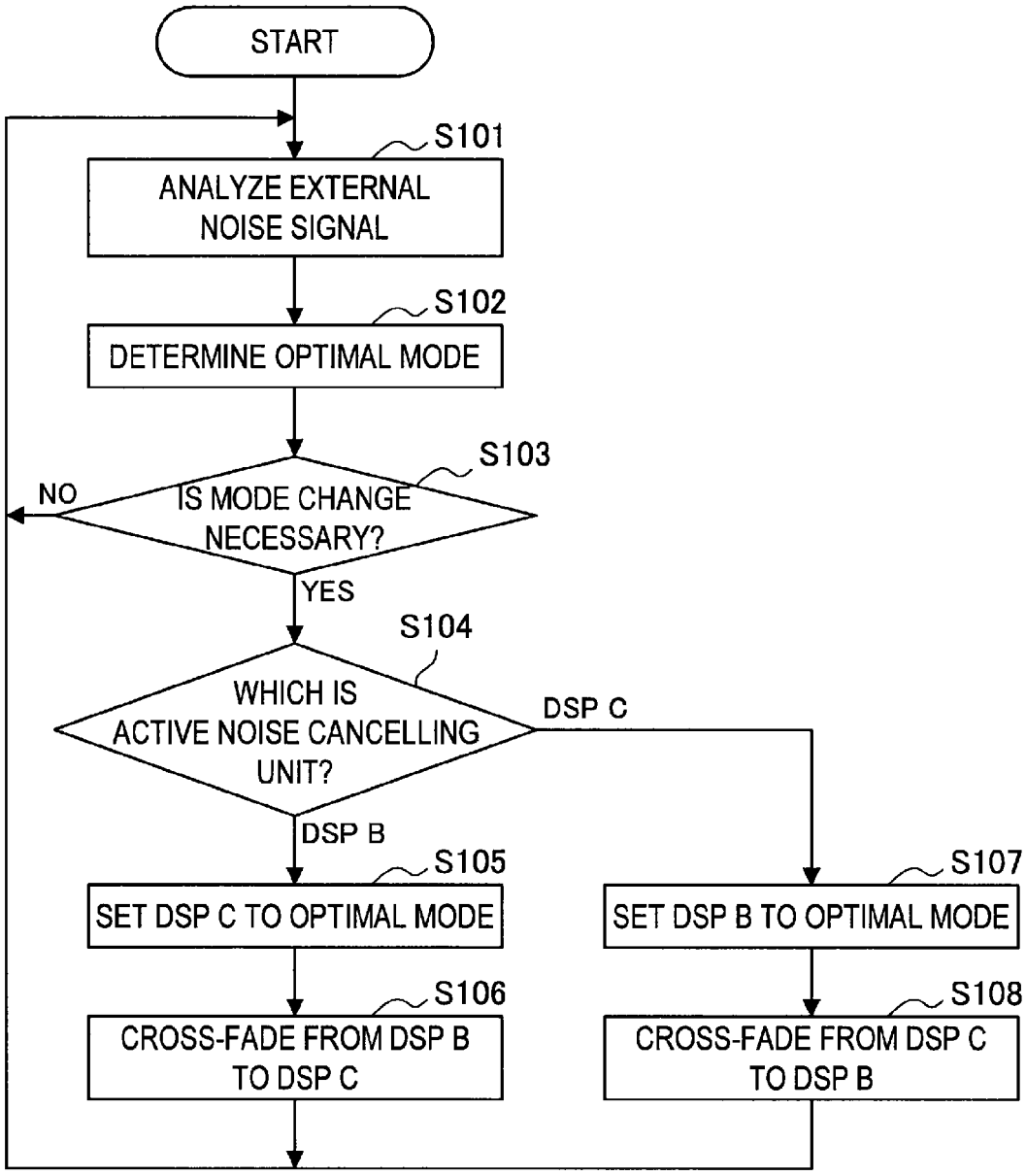
FIG. 6 is a flowchart showing an operation of the signal processing unit 30 according to the first embodiment of the present invention.

FIG. 6 is a flowchart showing the operation of the signal processing unit 30 according to the first embodiment of the present invention. Hereinafter, the operation of the signal processing unit 30 according to the first embodiment of the present invention will be described using FIG. 6.

If a noise signal converted into a digital signal by the ADC 10 is output to the signal processing unit 30, the noise analysis unit 31 analyzes the noise signal in a predetermined cycle (step S101). If the noise signal is analyzed by the noise analysis unit 31, the noise analysis unit 31 selects one optimal noise cancelling mode according to an analysis result (step S102).

If the noise analysis unit 31 selects one optimal noise cancelling mode in step S102 described above, the noise analysis unit 31 determines whether or not it is necessary to make a change to the selected noise cancelling mode (step S103). For example, the case where the noise cancelling mode selected by the noise analysis unit 31 is the mode A and a noise cancelling mode of the DSP B (the noise cancelling process unit 33*a*) currently in operation is the mode A is considered. In this case, it is not necessary to change to the noise cancelling mode selected by the noise analysis unit 31. On the other hand, the case where the noise cancelling mode selected by the noise analysis unit 31 is the mode B and the noise cancelling mode of the DSP B (the noise cancelling process unit 33*a*) currently in operation is the mode A is considered. In this case, it is necessary to change to the noise cancelling mode selected by the noise analysis unit 31.

If the noise analysis unit 31 determines that it is not necessary to change the mode as a determination result of step S103 described above, the noise analysis unit 31 analyzes a noise signal by returning to step S101 described above without changing to the mode selected in step S102 described above. On the other hand, if the noise analysis unit 31 determines that it is necessary to change the mode as the determination result of step S103 described above, the noise analysis unit 31 subsequently determines whether a current active DSP (in operation) is either the DSP B or the DSP C (step S104).

If the noise analysis unit 31 determines that the current active DSP (in operation) is the DSP B as a determination result of step S104 described above, the noise analysis unit 31 sets the DSP C (the noise cancelling process unit 33*b*) to the optimal noise cancelling mode selected in step S102 described above (step S105). If the optimal noise cancelling mode is set to the DSP C, the noise analysis unit 31 gradually performs switching to the optimal mode by cross-fading an output of the cross-fade unit 35 from the DSP B to the DSP C (step S106). That is, before the mode is switched, Output of Multiplication Unit 36*a*:Output of Multiplication Unit 36*b*=1:0. If the cross-fade process is started, the noise analysis unit 31 sets the cross-fade unit 35 to gradually increase the output of the multiplication unit 36*b* when the output of the multiplication unit 36*a* is gradually decreased. Finally, the cross-fade process of the cross-fade unit 35 is completed by setting Output of Multiplication Unit 36*a*:Output of Multiplication Unit 36*b*=0:1.

On the other hand, if the noise analysis unit 31 determines that the current active DSP (in operation) is the DSP C as the determination result of step S104 described above, the noise analysis unit 31 sets the DSP B (the noise cancelling process unit 33*a*) to the optimal noise cancelling mode selected in step S102 described above (step S107). If the optimal noise cancelling mode is set to the DSP B, the noise analysis unit 31 gradually performs switching to the optimal mode by cross-fading an output of the cross-fade unit 35 from the DSP C to the DSP B (step S108). That is, before the mode is switched, Output of Multiplication Unit 36*a*:Output of Multiplication Unit 36*b*=0:1. If the cross-fade process is started, the noise analysis unit 31 sets the cross-fade unit 35 to gradually increase the output of the multiplication unit 36*a* when the output of the multiplication unit 36*b* is gradually decreased. Finally, the cross-fade process of the cross-fade unit 35 is completed by setting Output of Multiplication Unit 36*a*:Output of Multiplication Unit 36*b*=1:0.

If the cross-fade process is completed in step S106 or S108 described above, the noise analysis unit 31 re-executes the analysis of a noise signal by returning to step S101 described above. Of course, in this embodiment, it is not necessary to stop an operation of outputting an audio signal that is output from the music reproduction device or the like connected to the headphones 1 and superimposed on a noise cancelling signal while a series of processes shown in FIG. 6 are executed.

Figure 7:
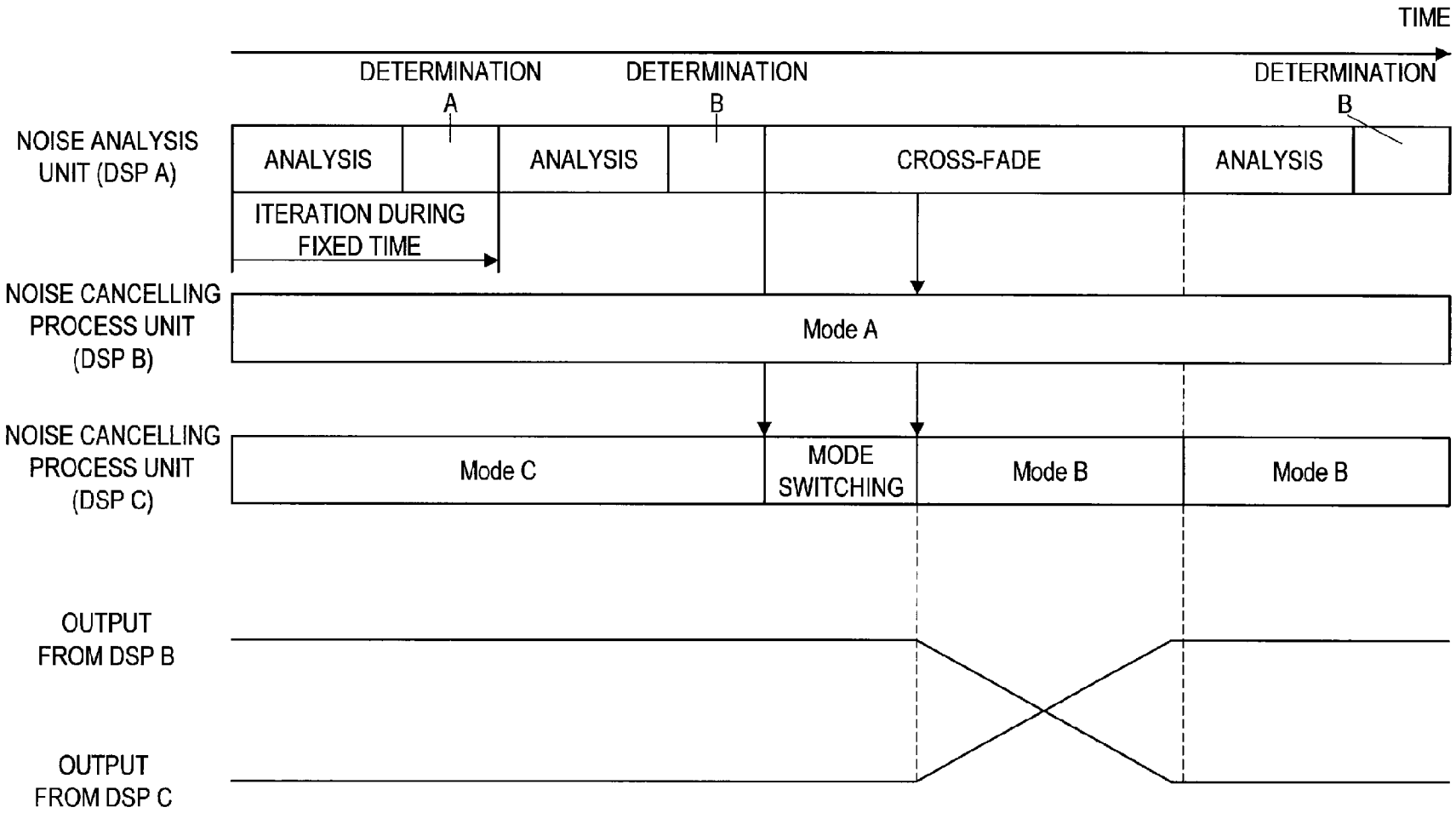
FIG. 7 is an illustrative diagram showing the operation of the signal processing unit 30 according to the first embodiment of the present invention in a sequence diagram.

FIG. 7 is an illustrative diagram showing the operation of the signal processing unit 30 according to one embodiment of the present invention shown in FIG. 6 in a sequence diagram. In FIG. 7, the case where a DSP in operation is the DSP B and the DSP B operates in the mode A is shown. FIG. 7 shows the case where the optimal noise cancelling mode is determined to be the mode B as a result of analysis process of the noise analysis unit 31 and the cross-fade from the DSP B to the DSP C is made.

The noise analysis unit 31 (the DSP A) executes the analysis of a noise signal converted into a digital signal by the ADC 10 at a predetermined interval, and selects the optimal noise cancelling mode for cancelling the noise signal. If it is necessary to change the optimal noise cancelling mode as the result of analysis of the noise analysis unit 31, the noise analysis unit 31 instructs the inactive DSP C (the noise cancelling process unit 33*b*) to change to the mode B.

The DSP C (the noise cancelling process unit 33*b*) receiving the instruction to change to the mode B performs switching to a coefficient corresponding to the mode B. The noise analysis unit 31 cross-fades an output of the DSP B and an output of the DSP C. The output of the DSP B and the output of the DSP C are linearly varied and the two outputs intersect at a middle point as shown in FIG. 7, but the variation of the output of the DSP B and the output of the DSP C in the cross-fade process of the present invention is not limited to the above-described example.

In FIG. 7, the timing when the cross-fade is completed is different from the start timing of the analysis process of the noise analysis unit 31 after the completion of the cross-fade. This shows that the analysis process of the noise analysis unit 31 is resumed after waiting for the cross-fade to be fully completed. Of course, the present invention is not limited to the above-described example. For example, the timing when the cross-fade is completed may be the same as the start timing of the analysis process of the noise analysis unit 31 after the completion of the cross-fade, and the analysis process of the noise analysis unit 31 may be resumed without waiting for the cross-fade to be completed.

The operation of the signal processing unit 30 according to one embodiment of the present invention has been described above. The headphones 1 according to this embodiment can automatically follow the optimal noise cancelling mode even when a state of noise around the user is varied by operating the signal processing unit 30 as described above. The headphones 1 according to this embodiment make a cross-fade by gradually varying outputs of two DSPs without instantly performing switching when the noise cancelling mode is switched. According to this cross-fade process, the headphones 1 according to this embodiment can switch the mode without generating abnormal noise during mode switching or stopping an output of an audio signal or a noise cancelling process.

Figure 8:
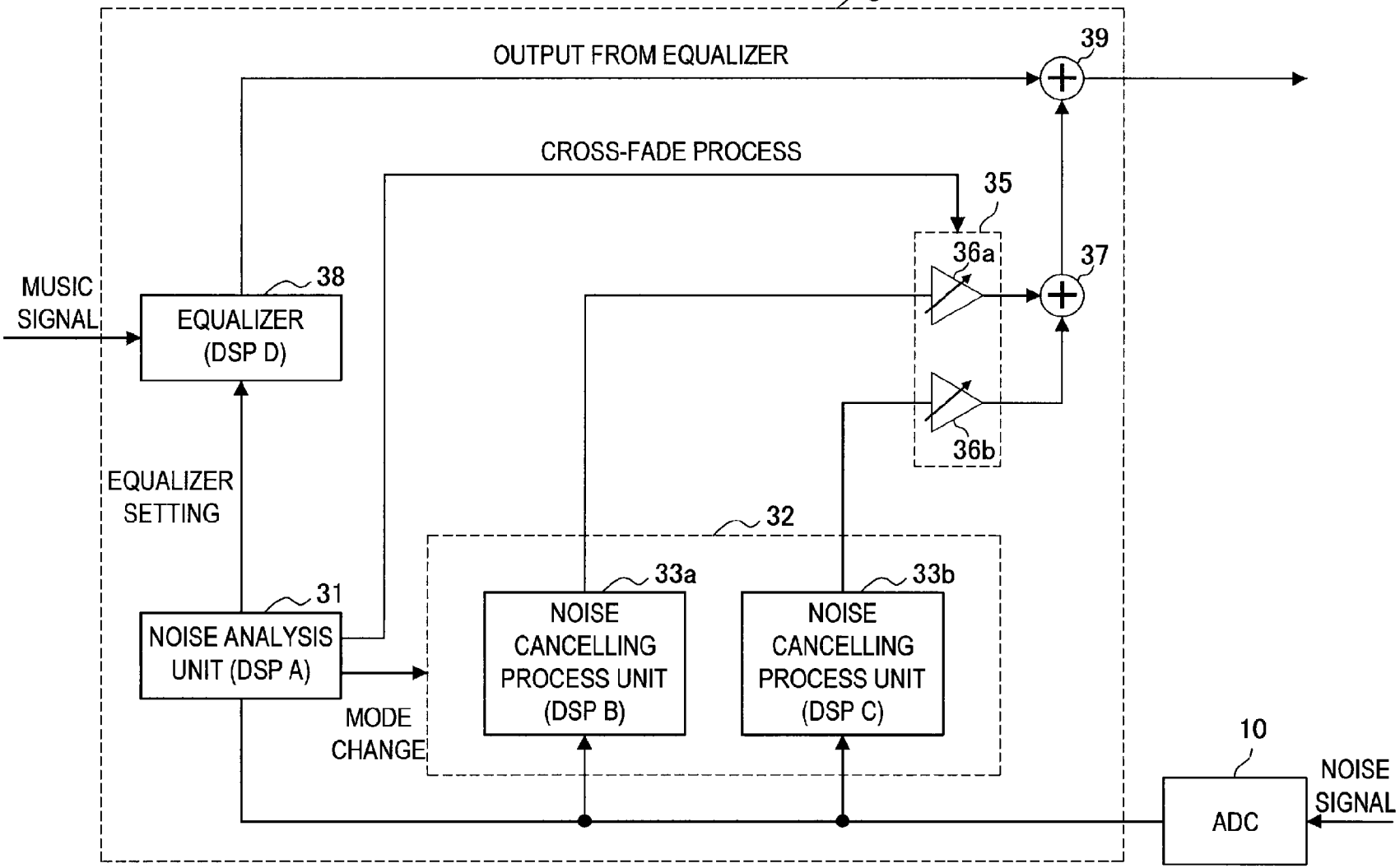
FIG. 8 is an illustrative diagram showing a modified example of the signal processing unit 30 according to the first embodiment of the present invention.

The signal processing unit 30 can also execute a process for an audio signal. FIG. 8 is an illustrative diagram showing a modified example of the signal processing unit 30 according to the first embodiment of the present invention. Hereinafter, the modified example of the signal processing unit 30 according to the first embodiment of the present invention will be described using FIG. 8.

[1-5. Configuration of Modified Example of Signal Processing Unit]

As compared with the configuration shown in FIG. 3, the modified example of the signal processing unit 30 according to the first embodiment of the present invention shown in FIG. 8 additionally includes an equalizer 38 and an addition unit 39. The equalizer 38 executes an equalization process for a music signal transmitted from the music reproduction device or the like connected to the headphones 1. The equalization process for the music signal is, for example, a process of emphasizing or de-emphasizing a signal of a specific sound range by processing a signal in a predetermined frequency band. In this modified example, the setting of the equalization process of the equalizer 38 (equalizer setting) can change according to the noise cancelling mode selected by the noise analysis unit 31. The equalization process of the equalizer 38 may be executed by a DSP. In FIG. 8, the equalization process of the equalizer 38 to be executed by the DSP is shown. An output of the equalizer 38 is added to a cancelling signal output from the addition unit 37 by the addition unit 39. An output of the addition unit 39 is output to the DAC 40 and is converted into a digital signal by the DAC 40.

An example in which the noise analysis process of the noise analysis unit 31 and the equalization process of the equalizer 38 are executed by separate DSPs is shown in FIG. 8, but the present invention is not limited to the above-described example. The noise analysis process of the noise analysis unit 31 and the equalization process of the equalizer 38 may be executed by the same DSP. A music signal is transferred to the equalizer 38 in FIG. 8, but, of course, a target of the equalization process is not limited to a signal for reproducing music in the present invention.

If the noise analysis process and the equalization process are executed by the same DSP, a different equalization process may be executed according to whether or not the full automatic optimal-mode selection function is valid.

[1-6. Operation of Modified Example of Signal Processing Unit]

Figure 9:
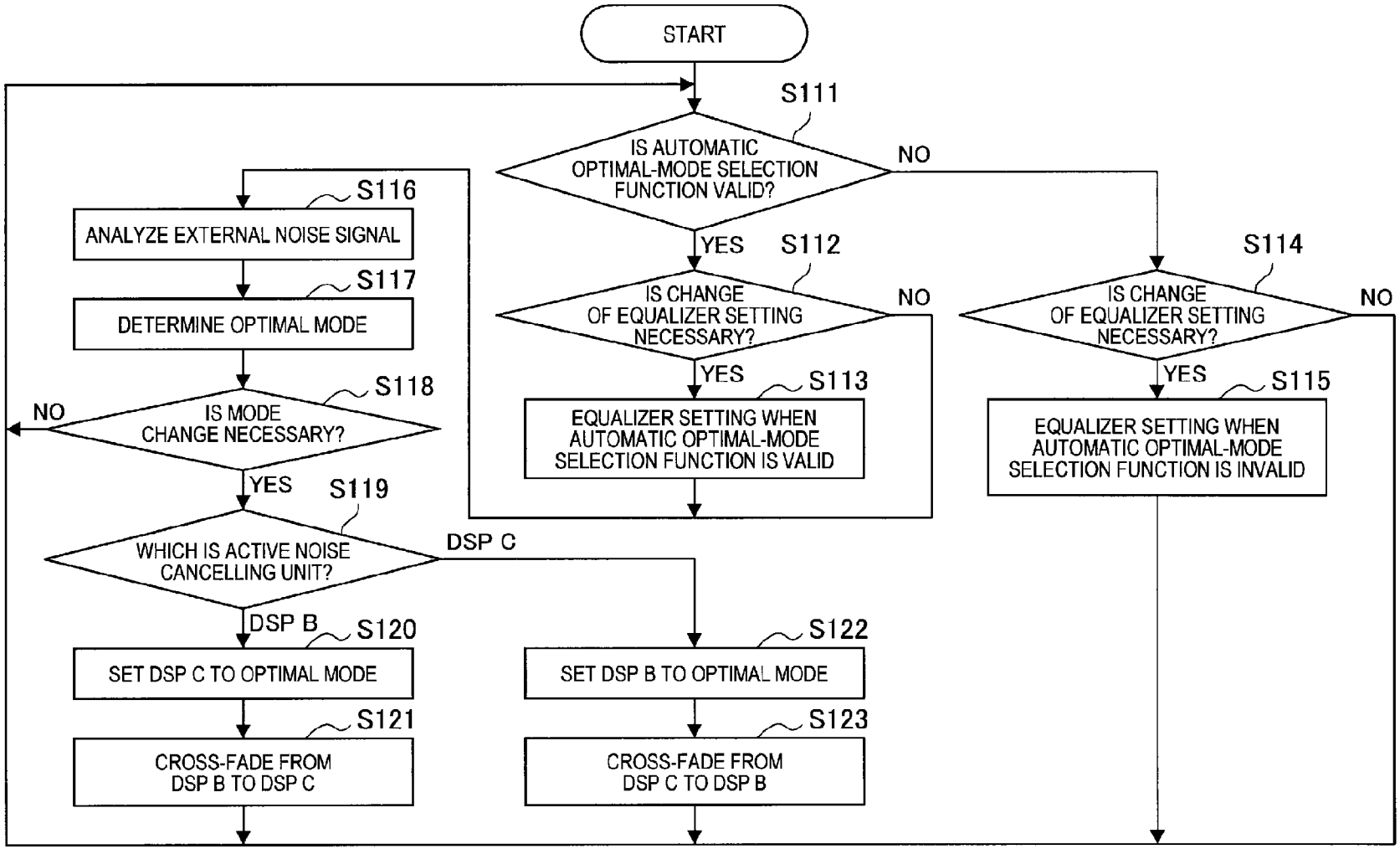
FIG. 9 is a flowchart illustrating an operation of the modified example of the signal processing unit 30 according to the first embodiment of the present invention.

FIG. 9 is a flowchart illustrating an operation of the modified example of the signal processing unit 30 according to the first embodiment of the present invention. Hereinafter, the operation of the modified example of the signal processing unit 30 according to the first embodiment of the present invention will be described using FIG. 9.

First, it is determined whether or not the full automatic optimal-mode selection function is valid in the headphones 1 (step S111). For example, a microprocessor and other control units may be embedded in the headphones 1, and hence the determination may be executed by the control unit. If the full automatic optimal-mode selection function is determined to be valid in the headphones 1 as a determination result of step S111, it is subsequently determined whether or not a setting change of the equalizer 38 is necessary (step S112). For example, the determination may be executed by the equalizer 38. If the setting change of the equalizer 38 is determined to be necessary as a determination result of step S112, the equalizer 38 is set for setting in which the full automatic optimal-mode selection function is valid (step S113). On the other hand, if the setting change of the equalizer 38 is determined to be unnecessary as the determination result of step S112, the process proceeds to the next processing by skipping the above-described processing of step S113.

If the full automatic optimal-mode selection function is determined to be invalid in the headphones 1 as a result of determination of step S111, it is subsequently determined whether or not the setting change of the equalizer 38 is necessary (step S114). For example, the determination may be executed by the equalizer 38. If the setting change of the equalizer 38 is determined to be necessary as a determination result of step S114, the equalizer 38 is set to a setting in which the full automatic optimal-mode selection function is invalid (step S115). If the equalizer 38 is set to a setting in which the full automatic optimal-mode selection function is invalid, a process of determining whether or not the full automatic optimal-mode selection function is valid in the headphones 1 is re-executed by returning to step S111 described above. On the other hand, if the setting change of the equalizer 38 is determined to be unnecessary as the determination result of step S114, the process returns to step S111 described above by skipping the above-described processing of step S115.

Processing subsequent to step S113 is the same as that of the flow of the operation of the signal processing unit 30 shown in FIG. 6. Hereinafter, the flow of the operation of the signal processing unit 30 will be re-described for confirmation.

The noise analysis unit 31 analyzes a noise signal converted into a digital signal by the ADC 10 (step S116). If the noise signal is analyzed by the noise analysis unit 31, the noise analysis unit 31 selects one optimal noise cancelling mode according to an analysis result (step S117). If the noise analysis unit 31 selects one optimal noise cancelling mode in step S117, the noise analysis unit 31 determines whether or not it is necessary to make a change to the selected noise cancelling mode (step S118). If the noise analysis unit 31 determines that it is not necessary to change the mode as a determination result of step S118, the change to the mode selected in step S116 described above is not made. In this case, a process of determining whether or not the full automatic optimal-mode selection function is valid in the headphones 1 is re-executed by returning to step S111 described above. On the other hand, if the noise analysis unit 31 determines that it is necessary to change the mode as the determination result of step S118 described above, the noise analysis unit 31 subsequently determines whether a current active DSP (in operation) is either the DSP B or the DSP C (step S119).

If the noise analysis unit 31 determines that the current active DSP (in operation) is the DSP B as a determination result of step S119 described above, the noise analysis unit 31 sets the DSP C (the noise cancelling process unit 33*b*) to the optimal noise cancelling mode selected in step S117 described above (step S120). If the optimal noise cancelling mode is set to the DSP C, the noise analysis unit 31 gradually performs switching to the optimal mode by cross-fading an output of the cross-fade unit 35 from the DSP B to the DSP C (step S121).

On the other hand, if the noise analysis unit 31 determines that the current active DSP (in operation) is the DSP C as the determination result of step S119 described above, the noise analysis unit 31 sets the DSP B (the noise cancelling process unit 33*a*) to the optimal noise cancelling mode selected in step S117 described above (step S122). If the optimal noise cancelling mode is set to the DSP B, the noise analysis unit 31 gradually performs switching to the optimal mode by cross-fading an output of the cross-fade unit 35 from the DSP C to the DSP B (step S123).

If the cross-fade process is completed in step S121 or S123 described above, a process of determining whether or not the full automatic optimal-mode selection function is valid in the headphones 1 is re-executed by returning to step S111 described above.

The modified example of the signal processing unit 30 according to the first embodiment of the present invention has been described above. Of course, in this modified example, it is not necessary to stop an operation of outputting a music signal that is output from the music reproduction device or the like connected to the headphones 1 and superimposed on a noise cancelling signal while a series of processes shown in FIG. 9 are executed. As described above, setting for the equalizer 38 can differ according to whether or not the full automatic optimal-mode selection function is valid in the headphones 1 in the modified example of the signal processing unit 30 according to the first embodiment of the present invention.

As described above, the headphones 1 according to the first embodiment of the present invention analyze a noise sound of an external environment collected by the microphone 2 while the full automatic optimal-mode selection function is executed, and select one optimal noise cancelling mode based on an analysis result. If one optimal noise cancelling mode is selected, the headphones 1 are transitioned to the selected noise cancelling mode without stopping an audio output and a noise cancelling process. Upon switching to the selected noise cancelling mode, the cross-fade unit 35 cross-fades outputs from two noise cancelling process units. The headphones 1 according to the first embodiment of the present invention can provide a comfortable acoustic environment to the user by switching the noise cancelling mode as described above.

<2. Second Embodiment>

[2-1. Configuration of Signal Processing Unit]

Figure 10:
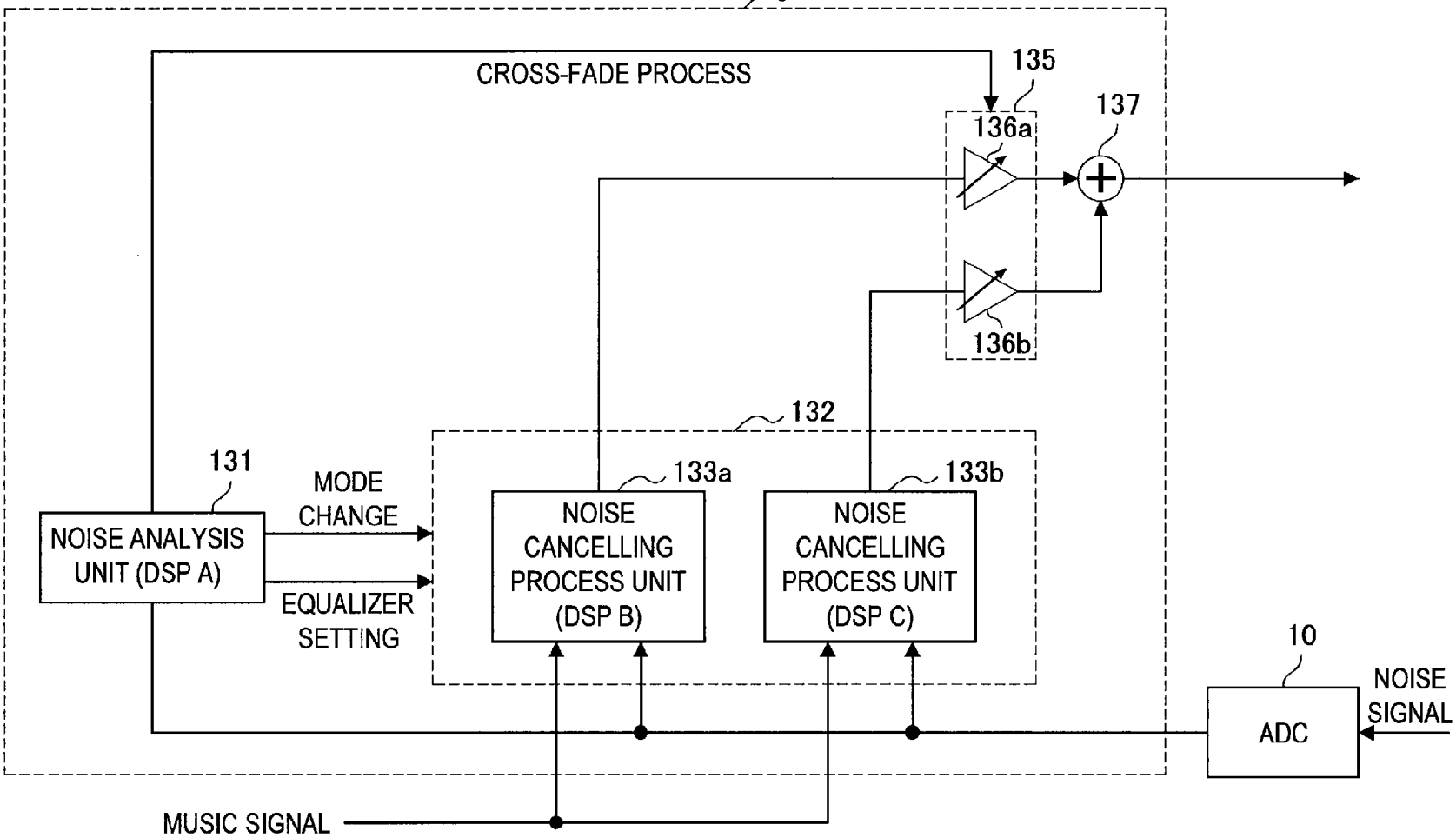
FIG. 10 is an illustrative diagram showing a configuration of a signal processing unit 130 according to a second embodiment of the present invention.

Next, the second embodiment of the present invention will be described. FIG. 10 is an illustrative diagram showing a configuration of a signal processing unit 130 according to the second embodiment of the present invention. In FIG. 10, an ADC 10 is also shown in conjunction with the signal processing unit 130. Hereinafter, the configuration of the signal processing unit 130 according to the second embodiment of the present invention will be described using FIG. 10.

The signal processing unit 130 shown in FIG. 10 can be replaced with the above-described signal processing unit 30. As shown in FIG. 10, the signal processing unit 130 according to the second embodiment of the present invention includes a noise analysis unit 131, a noise cancelling unit 132, a cross-fade unit 135, and an addition unit 137.

Like the noise analysis unit 31, the noise analysis unit 131 executes a process of analyzing a noise signal converted into a digital signal by the ADC 10. The analysis process of the noise analysis unit 131 is constantly executed at a predetermined interval while a full automatic optimal-mode selection function is valid. The noise analysis unit 131 executes a frequency characteristic analysis of a noise signal by performing band dividing of the noise signal or the like, for example, based on an FFT or a BPF. On the basis of the result of frequency characteristic analysis, the noise analysis unit 131 selects an optimal noise cancelling mode, and instructs the noise cancelling unit 132 to execute the noise cancelling process in the noise cancelling mode.

The noise analysis unit 131 outputs an equalizer setting to the noise cancelling unit 132. The noise analysis unit 131 may decide an optimal equalizer setting based on a result of execution of the analysis process for the noise signal, and output the equalizer setting to the noise cancelling unit 132. For example, the noise analysis unit 131 can estimate a spectrum of the remaining noise after the noise cancelling effect is obtained, and decide an equalizer setting to execute an equalization process to increase a level of a music signal in reinforcement in a band in which the remaining noise is strong. The noise analysis unit 131 may output an equalizer setting manually set by the user manipulating the manipulation unit 20 or the like to the noise cancelling unit 132.

The process of analyzing the noise signal by the noise analysis unit 131 may be executed by a DSP. In this embodiment, the DSP for executing the process of analyzing the noise signal by the noise analysis unit 131 is designated as a DSP A.

Like the noise cancelling unit 32, the noise cancelling unit 132 generates a signal for eliminating external noise reaching the ear of the user wearing the headphones 1 from the noise signal converted into the digital signal by the ADC 10. The noise cancelling unit 32 includes noise cancelling units 133*a* and 133*b*.

Each of the noise cancelling units 133*a* and 133*b* generates a noise cancelling signal for eliminating external noise reaching the ear of the user wearing the headphones 1 by performing a predetermined digital filtering operation on the noise signal converted into the digital signal by the ADC 10. The noise cancelling units 133*a* and 133*b* also execute the equalization process for the music signal. Hereinafter, a configuration of an example of the noise cancelling unit 133*a* will be described.

Figure 11:
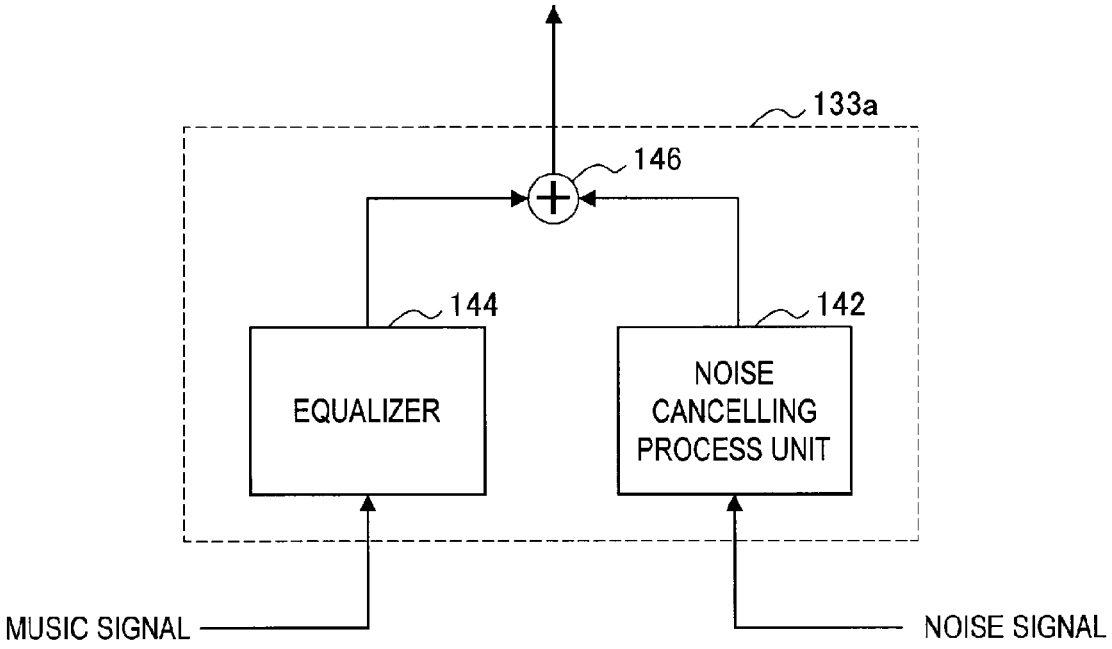
FIG. 11 is an illustrative diagram showing a configuration of a noise cancelling unit 133*a* according to the second embodiment of the present invention.

FIG. 11 is an illustrative diagram showing the configuration of the noise cancelling unit 133*a* according to the second embodiment of the present invention. As shown in FIG. 11, the noise cancelling unit 133*a* according to the second embodiment of the present invention includes a noise cancelling process unit 142, an equalizer 144, and an addition unit 146.

The noise cancelling process unit 142 executes a process of generating a noise cancelling signal for eliminating external noise reaching the ear of the user wearing the headphones 1 by performing a predetermined digital filtering operation on the noise signal converted into the digital signal by the ADC 10. The noise cancelling process unit 142 may be constituted, for example, by an FIR filter.

Like the equalizer 38 according to the first embodiment of the present invention described above, the equalizer 144 executes an equalization process for a music signal transmitted from the music reproduction device or the like connected to the headphones 1.

The addition unit 146 adds the noise cancelling signal generated by the noise cancelling process unit 142 to the music signal for which the equalization process is executed by the equalizer 144, and outputs an addition result.

The noise cancelling unit 133*a* is constituted as described above, so that the noise cancelling unit 133*a* can execute the process of generating the noise cancelling signal and the equalization process for the music signal. The noise cancelling unit 133*a* is constituted as described above, so that the noise analysis unit 131 can decide the optimal noise cancelling mode and the equalizer setting according to the noise signal input to the signal processing unit 130. The configuration of the example of the noise cancelling unit 133*a* has been described in FIG. 11, but, of course, the noise cancelling unit 133*b* can also have the same configuration.

The process of generating the noise cancelling signal and the equalization process for the music signal by the noise cancelling units 133*a* and 133*b* may be executed by DSPs. In this embodiment, the DSP for executing the filtering operation by the noise cancelling unit 133*a* is designated as a DSP B, and the DSP for executing the filtering operation by the noise cancelling unit 133*b* is designated as a DSP C.

When the noise cancelling mode is switched, the cross-fade unit 135 is designed to cross-fade outputs of the noise cancelling units 133*a* and 133*b* in response to an instruction from the noise analysis unit 131. The cross-fade unit 135 includes multiplication units 136*a* and 136*b*. The multiplication units 136*a* and 136*b* respectively multiply outputs of the noise cancelling units 133*a* and 133*b* by time-variant coefficients (gains) in response to an instruction from the noise analysis unit 131. Data multiplied by the multiplication units 136*a* and 136*b* is output to the addition unit 137.

The addition unit 137 adds outputs of the multiplication units 136*a* and 136*b* and outputs an addition result. An output of the addition unit 137 becomes a noise cancelling signal to be output to a DAC (not shown).

The configuration of the signal processing unit 130 according to the second embodiment of the present invention has been described above. Next, an operation of the signal processing unit 130 according to the second embodiment of the present invention will be described.

[2-2. Operation of Signal Processing Unit]

Figure 12:
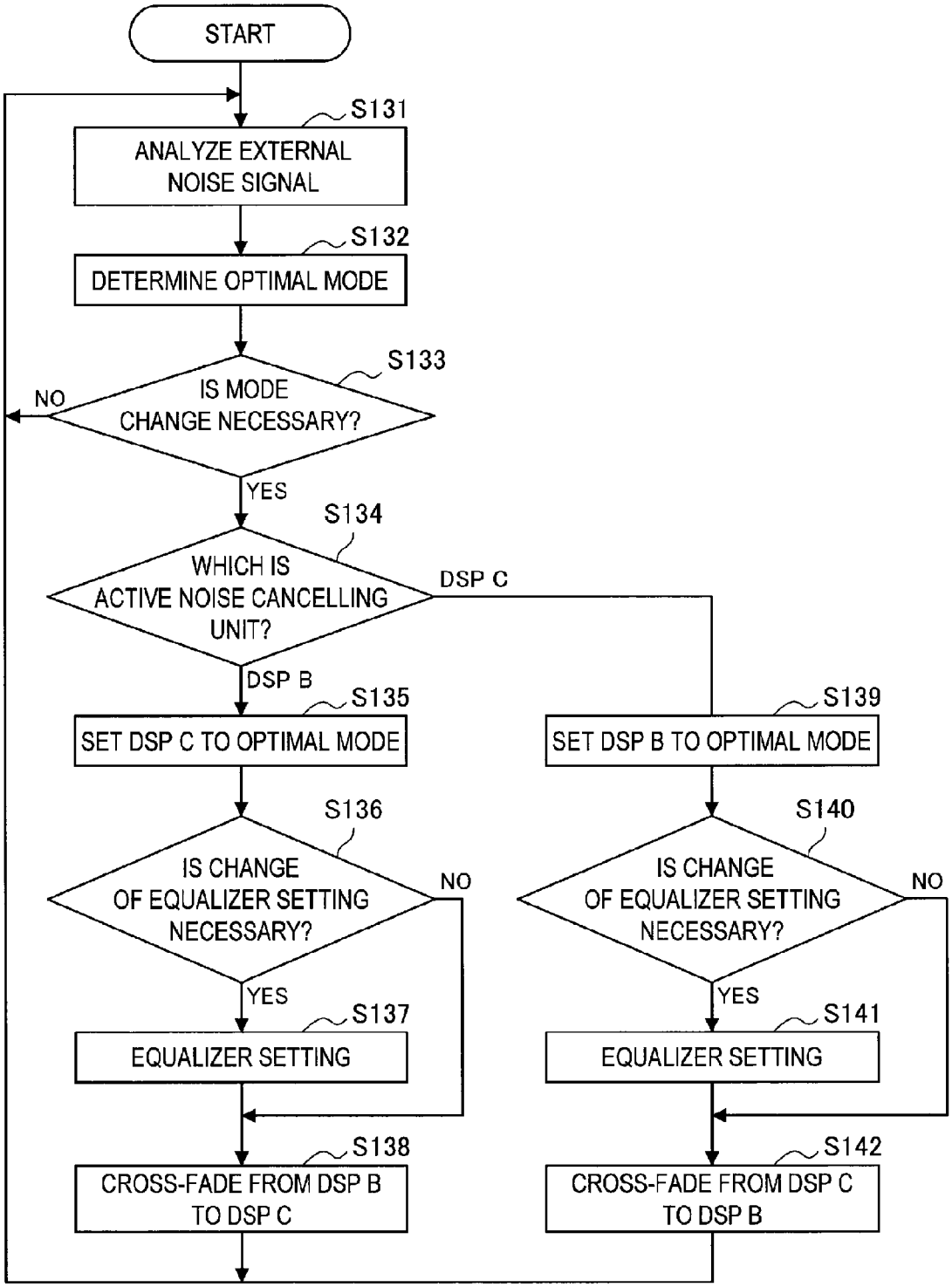
FIG. 12 is a flowchart showing an operation of the signal processing unit 130 according to the second embodiment of the present invention.

FIG. 12 is a flowchart showing the operation of the signal processing unit 130 according to the second embodiment of the present invention. Hereinafter, the operation of the signal processing unit 130 according to the second embodiment of the present invention will be described using FIG. 12.

If a noise signal converted into a digital signal by the ADC 10 is output to the signal processing unit 130, the noise analysis unit 131 analyzes the noise signal in a predetermined cycle (step S131). If the noise signal is analyzed by the noise analysis unit 131, the noise analysis unit 131 selects one optimal noise cancelling mode according to an analysis result (step S132).

If the noise analysis unit 131 selects one optimal noise cancelling mode in step S132 described above, the noise analysis unit 131 determines whether or not it is necessary to change to the selected noise cancelling mode (step S133). For example, the case where the noise cancelling mode selected by the noise analysis unit 31 is the mode A and the noise cancelling mode of the DSP B (the noise cancelling unit 133*a*) currently in operation is also the mode A is considered. In this case, it is not necessary to change to the noise cancelling mode selected by the noise analysis unit 131. On the other hand, the case where the noise cancelling mode selected by the noise analysis unit 131 is the mode B and the noise cancelling mode of the DSP B (the noise cancelling unit 133*a*) currently in operation is the mode A is considered. In this case, it is necessary to change to the noise cancelling mode selected by the noise analysis unit 131.

If the noise analysis unit 131 determines that it is not necessary to change the mode as a determination result of step S133 described above, the noise analysis unit 131 analyzes a noise signal by returning to step S131 described above without changing to the mode selected in step S132 described above. On the other hand, if the noise analysis unit 131 determines that it is necessary to change the mode as the determination result of step S133 described above, the noise analysis unit 131 subsequently determines whether a current active DSP (in operation) is either the DSP B or the DSP C (step S134).

If the noise analysis unit 131 determines that the current active DSP (in operation) is the DSP B as a determination result of step S134 described above, the noise analysis unit 131 sets the DSP C (the noise cancelling unit 133*b*) to the optimal noise cancelling mode selected in step S132 described above (step S135). If the optimal noise cancelling mode is set to the DSP C, the noise analysis unit 131 determines whether or not a change of an equalizer setting of the DSP C is necessary (step S136). If the change of the equalizer setting of the DSP C is determined to be necessary as a determination result of step S136, the noise analysis unit 131 performs the equalizer setting for the DSP C (step S137). The equalizer setting for the DSP C in step S137 is an optimal setting corresponding to the analysis result of the noise analysis unit 131, but the equalizer setting for the DSP C in the present invention is not limited to the above-described example. On the other hand, if the change of the equalizer setting of the DSP C is determined to be unnecessary as a determination result of step S136, the process proceeds to the next processing by skipping the above-described processing of step S137.

If the equalizer setting for the DSP C is completed, the noise analysis unit 131 subsequently gradually performs switching to the optimal mode by cross-fading an output of the cross-fade unit 135 from the DSP B to the DSP C (step S138).

On the other hand, if the noise analysis unit 131 determines that the current active DSP (in operation) is the DSP C as the determination result of step S134 described above, the noise analysis unit 131 sets the DSP B (the noise cancelling unit 133*a*) to the optimal noise cancelling mode selected in step S132 described above (step S139). If the optimal noise cancelling mode is set to the DSP B, the noise analysis unit 131 determines whether or not a change of an equalizer setting of the DSP B is necessary (step S140). If the change of the equalizer setting of the DSP B is determined to be necessary as a determination result of step S140, the noise analysis unit 131 performs the equalizer setting for the DSP B (step S141). The equalizer setting for the DSP B in step S141 is an optimal setting corresponding to the analysis result of the noise analysis unit 131, but the equalizer setting for the DSP B in the present invention is not limited to the above-described example. On the other hand, if the change of the equalizer setting of the DSP B is determined to be unnecessary as a determination result of step S140, the process proceeds to the next processing by skipping the above-described processing of step S141.

If the equalizer setting for the DSP B is completed, the noise analysis unit 131 subsequently gradually performs switching to the optimal mode by cross-fading an output of the cross-fade unit 135 from the DSP C to the DSP B (step S142).

If the cross-fade process is completed in step S138 or S142 described above, the noise analysis unit 131 re-executes the analysis of a noise signal by returning to step S131 described above.

The operation of the signal processing unit 130 according to the second embodiment of the present invention has been described above. Of course, in this embodiment, it is not necessary to stop an operation of outputting a music signal that is output from the music reproduction device or the like connected to the headphones 1 and superimposed on a noise cancelling signal while a series of processes shown in FIG. 12 are executed.

The signal processing unit 130 according to the second embodiment of the present invention as described above executes the process of generating the noise cancelling signal and the equalizer process for the music signal by the same DSP. If two DSPs are provided to execute these processes and a change of an optimal noise cancelling mode is made, outputs from the DSPs are switched by cross-fading the outputs of the two DSPs. The signal processing unit 130 according to the second embodiment of the present invention can provide the user with a comfortable acoustic environment by switching the noise cancelling mode as described above.

<3. Third Embodiment>

[3-1. Configuration of Signal Processing Unit]

Figure 13:
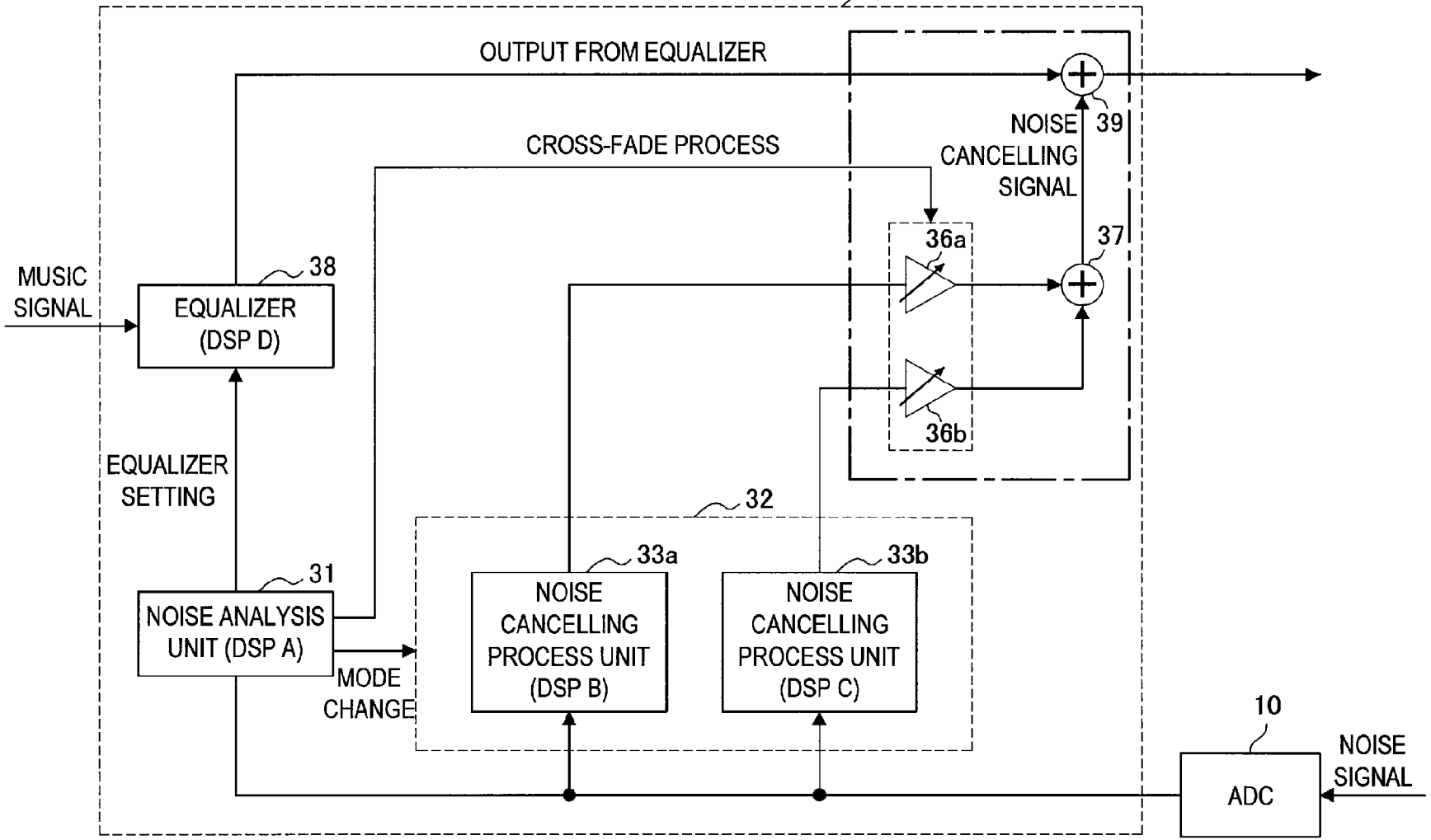
FIG. 13 is an illustrative diagram showing a modified example of the signal processing unit 30 according to the first embodiment of the present invention.

In the signal processing unit 30 according to the first embodiment of the present invention described above, the cross-fade unit 35 is configured as an external module of DSPs (the noise cancelling process units 33*a* and 33*b*). However, the cross-fade process is actually executed inside the DSP. In the signal processing unit 30 according to the first embodiment of the present invention, the addition units 37 and 39 are also configured as external modules. However, an addition process is also actually executed inside the DSP. FIG. 13 re-shows the illustrative diagram shown in the modified example of the signal processing unit 30 according to the first embodiment of the present invention shown in FIG. 8. Here, in general, a portion surrounded by a dashed-dotted line in FIG. 13 is configured to be incorporated inside the DSP. A configuration in which the cross-fade process and the addition process to be executed by the signal processing unit 30 according to the first embodiment of the present invention are incorporated inside the DSP in the third embodiment of the present invention will be described.

Figure 14:
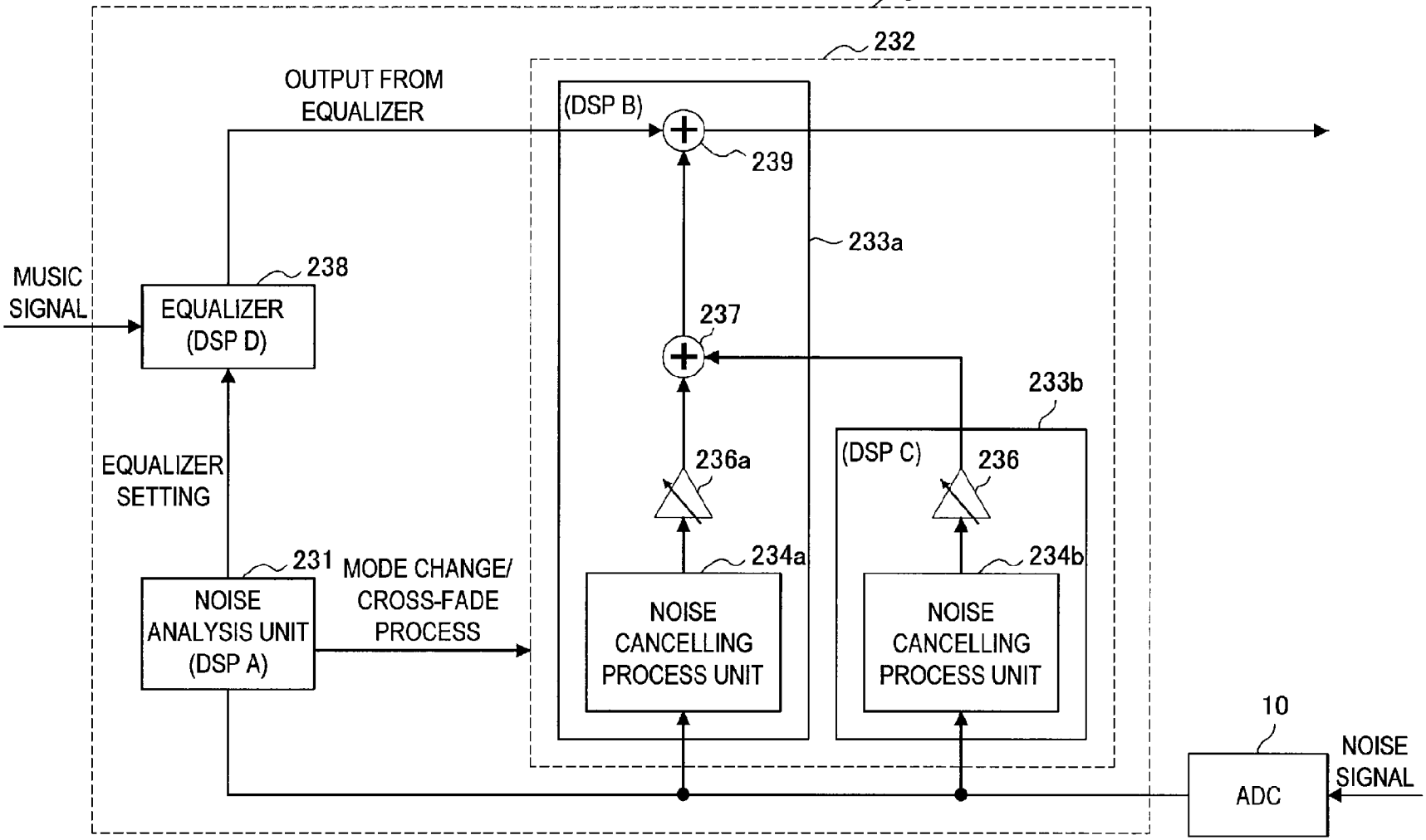
FIG. 14 is an illustrative diagram showing a configuration of a signal processing unit 230 according to a third embodiment of the present invention.

FIG. 14 is an illustrative diagram showing a configuration of a signal processing unit 230 according to the third embodiment of the present invention. In FIG. 14, the ADC 10 is also shown in conjunction with the signal processing unit 230. Hereinafter, the configuration of the signal processing unit 230 according to the third embodiment of the present invention will be described using FIG. 14.

The signal processing unit 130 shown in FIG. 14 can be replaced with the signal processing unit 30 described above. As shown in FIG. 14, the signal processing unit 230 according to the third embodiment of the present invention includes a noise analysis unit 231, a noise cancelling unit 232, and an equalizer 238.

Like the noise analysis units 31 and 131, the noise analysis unit 231 executes a process of analyzing a noise signal converted into a digital signal by the ADC 10. The analysis process of the noise analysis unit 231 is constantly executed at a predetermined interval while a full automatic optimal-mode selection function is valid. The noise analysis unit 231 executes a frequency characteristic analysis of a noise signal by performing band dividing of the noise signal or the like, for example, based on an FFT or a BPF. On the basis of the result of frequency characteristic analysis, the noise analysis unit 231 selects an optimal noise cancelling mode, and instructs the noise cancelling unit 232 to execute the noise cancelling process in the noise cancelling mode.

The noise analysis unit 231 outputs an equalizer setting to the equalizer 238. The noise analysis unit 231 may decide an optimal equalizer setting based on a result of execution of the analysis process for the noise signal, and output the equalizer setting to the equalizer 238. Like the equalizer 38, the equalizer 238 executes an equalization process for a music signal transmitted from the music reproduction device or the like connected to the headphones 1. For example, the noise analysis unit 231 can estimate a spectrum of the remaining noise after the noise cancelling effect is obtained, and decide an equalizer setting to execute an equalization process to increase a level of a music signal in reinforcement in a band in which the remaining noise is strong. The noise analysis unit 231 may output an equalizer setting manually set by the user manipulating the manipulation unit 20 or the like to the equalizer 238.

The process of analyzing the noise signal by the noise analysis unit 231 may be executed by a DSP. In this embodiment, the DSP for executing the process of analyzing the noise signal by the noise analysis unit 231 is designated as a DSP A.

Like the noise cancelling units 32 and 132, the noise cancelling unit 232 generates a signal for eliminating external noise reaching the ear of the user wearing the headphones 1 from the noise signal converted into the digital signal by the ADC 10. The noise cancelling unit 232 includes noise cancelling units 233*a* and 233*b*.

Each of the noise cancelling units 233*a* and 233*b* performs a predetermined digital filtering operation on the noise signal converted into the digital signal by the ADC 10. A noise cancelling signal for eliminating external noise reaching the ear of the user wearing the headphones 1 is generated by performing a predetermined digital filtering operation on the noise signal converted into the digital signal by the ADC 10. The noise cancelling unit 233*a* includes a noise cancelling process unit 234*a*, a multiplication unit 236*a*, and addition units 237 and 239. On the other hand, the noise cancelling unit 233*b* includes a noise cancelling process unit 234*b* and a multiplication unit 236*b*.

The noise cancelling process units 234*a* and 234*b* have the same functions as the noise cancelling process units 33*a* and 33*b*. That is, each of the noise cancelling process units 234*a* and 234*b* generates a signal for eliminating external noise reaching the ear of the user wearing the headphones 1 by performing a predetermined digital filtering operation on the noise signal converted into the digital signal by the ADC 10. The noise cancelling process units 234*a* and 234*b* may be constituted, for example, by FIR filters.

Like the multiplication units 236*a* and 236*b*, the multiplication units 236*a* and 236*b* respectively multiply outputs of the noise cancelling process units 234*a* and 234*b* by time-variant coefficients (gains) in response to an instruction from the noise analysis unit 231. Data multiplied by the multiplication units 236*a* and 236*b* is output to the addition unit 237.

The addition unit 237 adds outputs of the multiplication units 236*a* and 236*b* and outputs an addition result to the addition unit 239. The addition unit 239 adds an output of the addition unit 237 to an output of the equalizer 238 and outputs an addition result. An output of the addition unit 239 is output to the DAC 40, and is converted into a digital signal by the DAC 40.

The process of generating the noise cancelling signal, the multiplication process, and the addition process by the noise cancelling unit 233*a* may be executed by a DSP. In this embodiment, the DSP for executing each process by the noise cancelling unit 233*a* is designated as a DSP B. Likewise, the process of generating the noise cancelling signal and the multiplication process by the noise cancelling unit 233*b* may be executed by a DSP. In this embodiment, the DSP for executing each process by the noise cancelling unit 233*b* is designated as a DSP C.

An example in which the noise analysis process of the noise analysis unit 231 and the equalization process of the equalizer 238 are executed by separate DSPs is shown in FIG. 14, but the present invention is not limited to the above-described example. The noise analysis process of the noise analysis unit 231 and the equalization process of the equalizer 238 may be executed by the same DSP. If the noise analysis process and the equalization process are executed by the same DSP, a different equalization process may be executed according to whether or not the full automatic optimal-mode selection function is valid.

The configuration of the signal processing unit 230 according to the third embodiment of the present invention has been described above. Next, an operation of the signal processing unit 230 according to the third embodiment of the present invention will be described.

[3-2. Operation of Signal Processing Unit]

According to the configuration of the signal processing unit 230 as shown in FIG. 14, it is possible to expect the effect of reducing power consumption by stopping any one of the DSP B and the DSP C, except for when the cross-fade process is executed. In the configuration shown in FIG. 14, it is possible to stop the DSP C (the noise cancelling unit 233*b*). However, if the DSP B (the noise cancelling unit 233*a*) is stopped in the configuration as shown in FIG. 14, the addition unit 239 may not perform a process of adding the noise cancelling signal to the music signal. That is, there is a problem in that the DSP B, which should execute the addition process of the addition unit 239, may not be stopped and power consumption may not be reduced.

In order to solve the above-described problem in this embodiment, the DSP B is designated as a main DSP and the DSP C is designated as a sub-DSP. While the full automatic optimal-mode selection function is valid, the noise cancelling process is executed by the DSP B, which is the main DSP, and the DSP C, which is the sub-DSP, is set to a sleep mode having low power consumption or a power saving mode. At the timing when the noise analysis unit 231 determines that the optimal noise cancelling mode is varied, the DSP C, which is the sub-DSP, is started from the DSP A, and the DSP C is set to the determined optimal noise cancelling mode. If the DSP C is set to the determined optimal noise cancelling mode, the output of the noise cancelling signal is subsequently switched from the DSP B to the DSP C by the cross-fade process according to an instruction of the DSP A. If an output of the noise cancelling unit 232 is switched to an output of the noise cancelling signal from the DSP C, the DSP B is subsequently set to the optimal noise cancelling mode by an instruction of the DSP A. If the DSP B is set to the determined optimal noise cancelling mode, the output of the noise cancelling signal is subsequently switched from the DSP C to the DSP B by the cross-fade process according to an instruction of the DSP A. If the switching is completed, the DSP C, which is the sub-DSP, is subsequently set to the sleep mode having low power consumption or the power saving mode according to an instruction of the DSP A.

Figure 15:
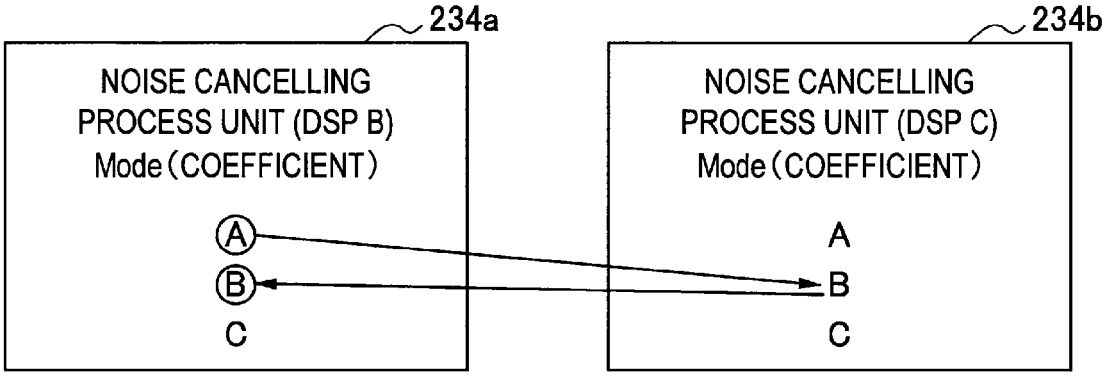
FIG. 15 is an illustrative diagram showing a mode transition between a main digital signal processor (DSP) and a sub-DSP.

FIG. 15 is an illustrative diagram showing a mode transition between the main DSP and the sub-DSP described above. In FIG. 15, the case where the noise cancelling mode is transitioned from a mode A to a mode B is shown.

Here, if the noise cancelling process unit 234*a* executes a noise cancelling process in the mode A, the optimal noise cancelling mode is changed to the mode B as an analysis result of the noise analysis unit 231. If the noise analysis unit 231 determines that the optimal mode is changed to the mode B, the noise analysis unit 231 starts the DSP C set to the sleep mode having low power consumption or the power saving mode. If the DSP C is started, the noise analysis unit 231 sets the noise cancelling mode of the noise cancelling process unit 234*b* included in the started DSP C to the mode B. If the noise cancelling mode of the noise cancelling process unit 234*b* is set to the mode B, the noise analysis unit 231 cross-fades and switches an output from the DSP B to the DSP C.

If the switching to the DSP C is completed, the noise analysis unit 231 changes the noise cancelling mode of the noise cancelling process unit 234*a* from the mode A to the mode B. If the noise cancelling mode of the noise cancelling process unit 234*a* is set to the mode B, the noise analysis unit 231 cross-fades and switches an output from the DSP C to the DSP B. If the switching to the DSP B is completed, the noise analysis unit 231 sets the DSP C to the sleep mode having low power consumption or the power saving mode.

Figure 16:
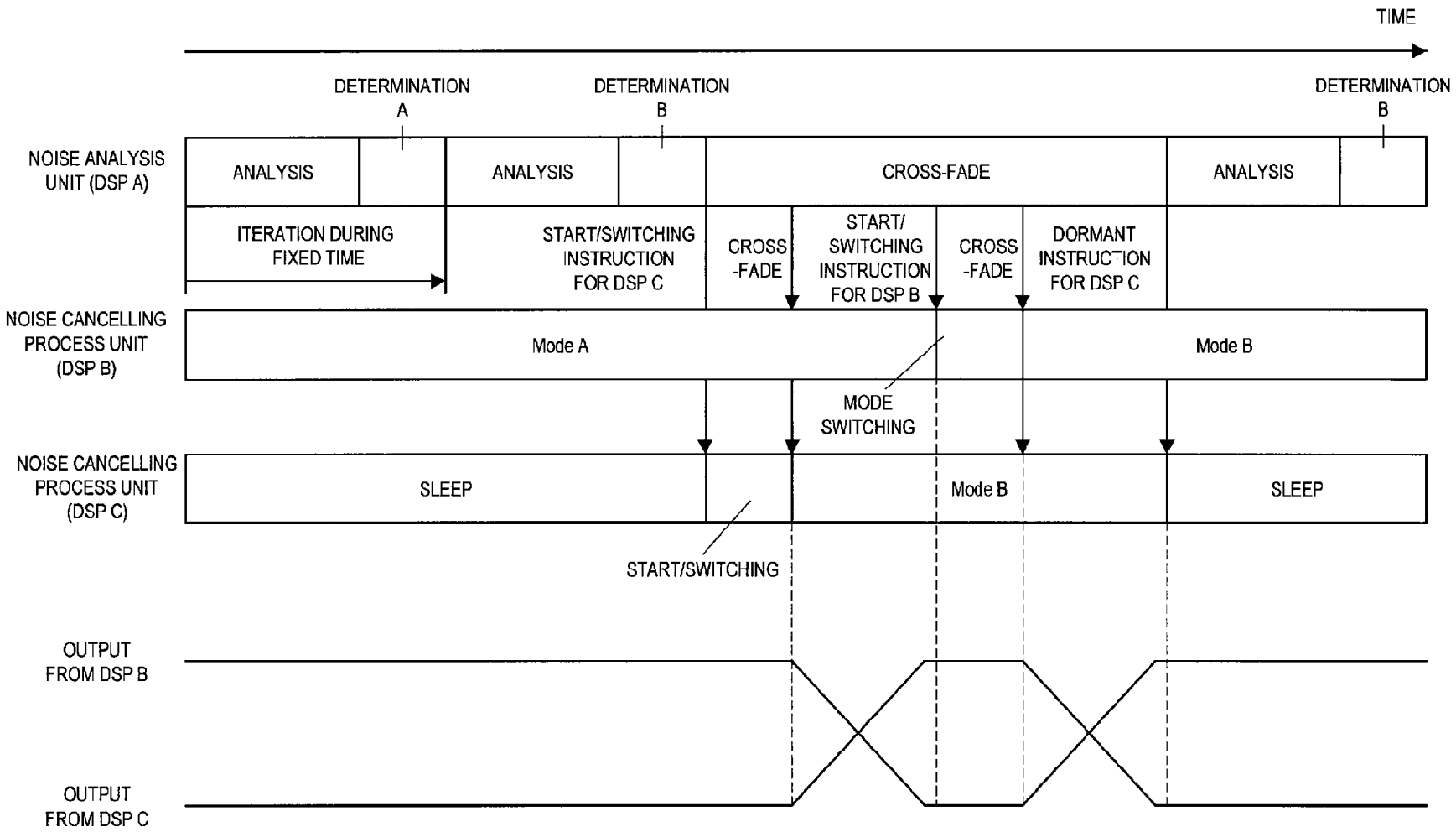
FIG. 16 is an illustrative diagram showing the mode transition between the main DSP and the sub-DSP in a sequence diagram.

FIG. 16 is an illustrative diagram showing the above-described mode transition between the main DSP and the sub-DSP in a sequence diagram. The case where the noise cancelling mode is transitioned from the mode A to the mode B is shown in FIG. 16 like FIG. 15.

The noise analysis unit 231 analyzes a noise signal at a predetermined interval and determines an optimal noise cancelling mode. In the DSP B, which is the main DSP, the noise cancelling process unit 234*a* executes a noise cancelling process in the mode A.

If the noise cancelling process unit 234*a* executes a noise cancelling process in the mode A, the optimal noise cancelling mode is changed to the mode B as an analysis result of the noise analysis unit 231. If the noise analysis unit 231 determines that the optimal mode is changed to the mode B, the noise analysis unit 231 starts the DSP C set to the sleep mode having low power consumption or the power saving mode. If the DSP C is started, the noise analysis unit 231 sets the noise cancelling mode of the noise cancelling process unit 234*b* to the mode B.

If the noise cancelling mode of the noise cancelling process unit 234*b* is set to the mode B, the noise analysis unit 231 cross-fades and switches an output from the DSP B to the DSP C.

If the switching to the DSP C is completed, the noise analysis unit 231 changes the noise cancelling mode of the noise cancelling process unit 234*a* from the mode A to the mode B. If the noise cancelling mode of the noise cancelling process unit 234*a* is set to the mode B, the noise analysis unit 231 cross-fades and switches an output from the DSP C to the DSP B. If the switching to the DSP B is completed, the noise analysis unit 231 outputs a dormant instruction to the DSP C and sets the DSP C to the sleep mode having low power consumption or the power saving mode.

When the noise cancelling mode is switched using two DSPs as described above, one DSP is driven as the main DSP and the other DSP is driven as the sub-DSP. The sub-DSP is started only upon mode switching, so that it is possible to automatically switch the noise cancelling mode without causing the user any strangeness or discomfort upon mode switching while suppressing power consumption.

The output of the DSP B and the output of the DSP C are linearly varied and the two outputs intersect at a middle point as shown in FIG. 16, but the variation of the output of the DSP B and the output of the DSP C in the cross-fade process of the present invention is not limited to the above-described example. For example, the outputs may be non-linearly varied so that the two outputs intersect at a point other than the middle point, and the timing when the output of the DSP B starts to be varied and the timing when the output of the DSP C starts to be varied may be shifted.

[3-3. Example of Configuration of Noise Analysis unit]

Figure 17:
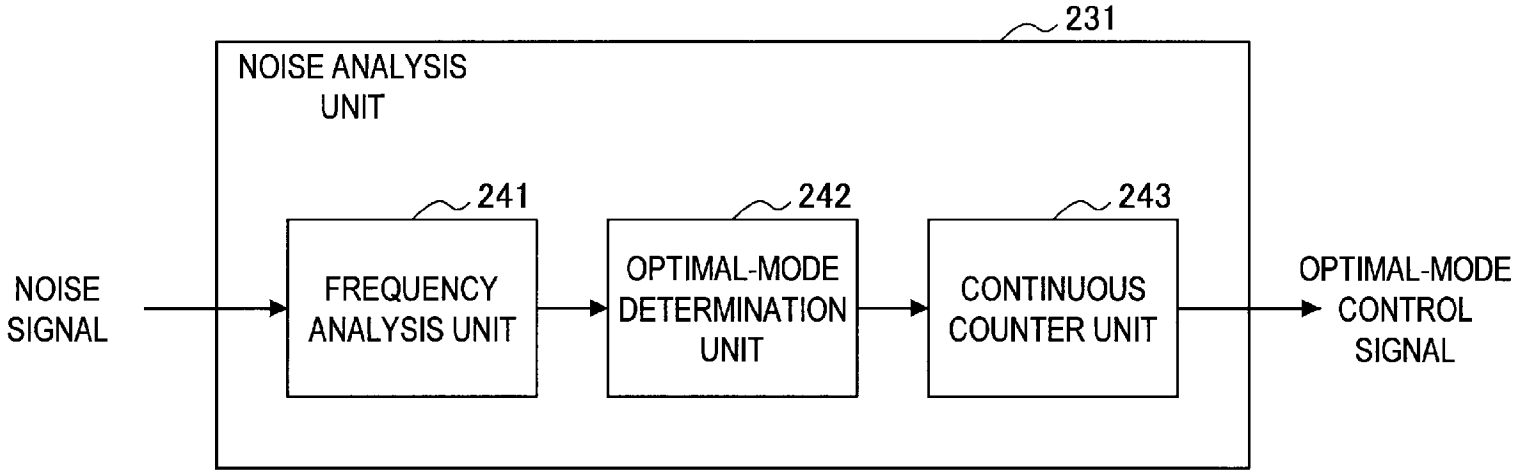
FIG. 17 is an illustrative diagram showing a configuration of a noise analysis unit 231 according to the third embodiment of the present invention.

Here, the example of the configuration of the noise analysis unit will now be described as an example of the noise analysis unit 231. FIG. 17 is an illustrative diagram showing the configuration of the noise analysis unit 231 according to the third embodiment of the present invention. Here, the configuration of the noise analysis unit 231 according to the third embodiment of the present invention will be described using FIG. 17.

As shown in FIG. 17, the noise analysis unit 231 according to the third embodiment of the present invention includes a frequency analysis unit 241, an optimal-mode determination unit 242, and a continuous counter unit 243.

The frequency analysis unit 241 executes a frequency characteristic analysis for a noise signal output to the noise analysis unit 231. The frequency analysis unit 241 may perform band dividing, for example, based on an FFT or BPF, for the noise signal. It is preferable that the number of BPFs be two or more. It is possible to recognize which frequency component is included in the noise signal by the frequency characteristic analysis of the frequency analysis unit 241.

The optimal-mode determination unit 242 determines an optimal noise cancelling mode from among pre-retained noise cancelling modes in a predetermined cycle using a result of frequency characteristic analysis for the noise signal in the frequency analysis unit 241. A determination cycle of the optimal-mode determination unit 242 may be one cycle in several seconds so that the mode is not transitioned when a variation of a noise state is completed, for example, in a short period in which electric trains pass each other. The optimal-mode determination unit 242 determines a noise cancelling mode to be used to eliminate noise. A mode determination process of the optimal-mode determination unit 242 may be performed, for example, to calculate a difference between a frequency characteristic analysis result of the frequency analysis unit 241 and a noise reduction characteristic of each noise cancelling mode and set a noise cancelling mode having a smallest difference to the optimal noise cancelling mode. The determination result of the optimal-mode determination unit 242 is output to the continuous counter unit 243.

The continuous counter unit 243 measures the number of determinations of the optimal-mode determination unit 242 continuously determining that the noise cancelling mode is different from an identical and current mode. If the measured number reaches the predetermined number of times, the continuous counter unit 243 outputs an optimal-mode control signal for setting the noise cancelling mode continuously determined by the optimal-mode determination unit 242. The continuous counter unit 243 measures the number of times if the same noise cancelling mode is continuously determined by the optimal-mode determination unit 242, and resets the number of times once a different noise cancelling mode is continuously determined by the optimal-mode determination unit 242. If the mode is immediately changed when the optimal mode is varied as the determination result of the optimal-mode determination unit 242, there is a possibility of the occurrence of the following phenomenon. If the variation of a state of ambient noise is completed, for example, in a short period in which electric trains pass each other, the noise already returns to the original state when the mode transition ends, and the optimal mode should be changed. Accordingly, it is possible to prevent the variation of a state of ambient noise that is completed during a short time from being followed by changing the mode on the condition that the same noise cancelling mode is continuously determined by the optimal-mode determination unit 242.

Figure 18:
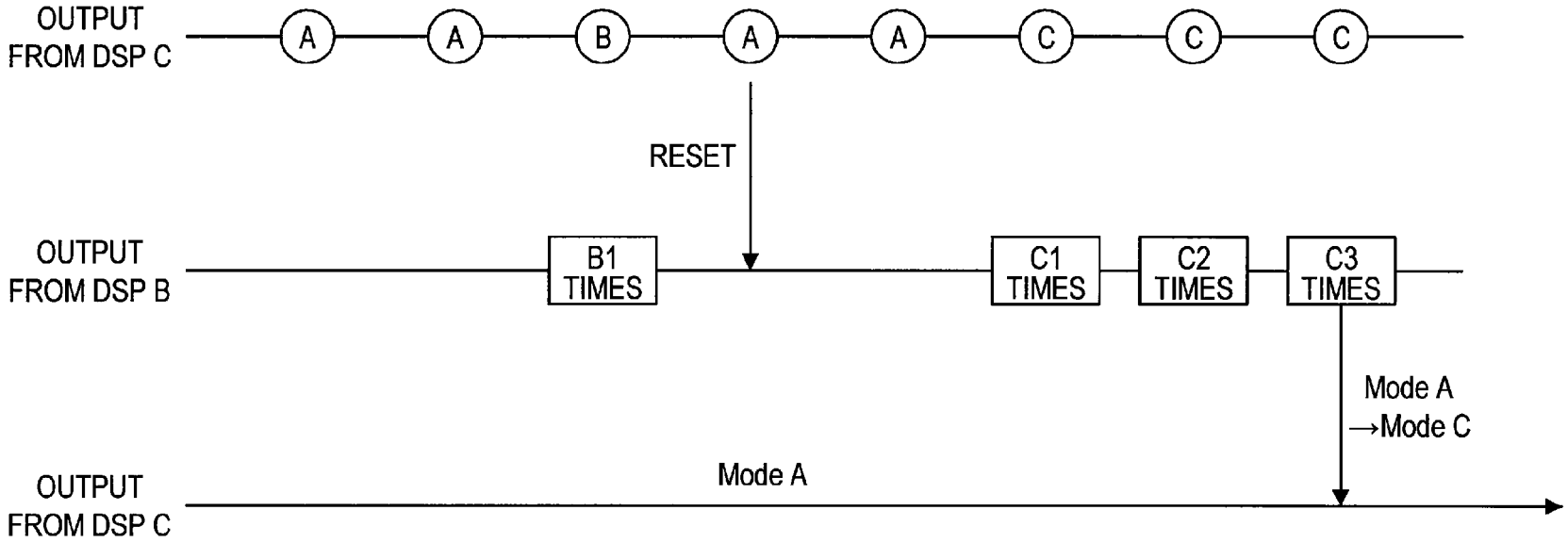
FIG. 18 is an illustrative diagram showing an example of a relationship between a determination result of an optimal-mode determination unit 242 and a counting result of a continuous counter unit 243.

FIG. 18 is an illustrative diagram showing an example of a relationship between a determination result of the optimal-mode determination unit 242 and a counting result of the continuous counter unit 243. FIG. 18 shows an example of a state in which a noise state of an external environment varies when the optimal noise cancelling mode is the mode A.

It is assumed that the optimal-mode determination unit 242 determines that the optimal noise cancelling mode is the mode B after the noise state of the external environment varies when the optimal noise cancelling mode is the mode A. Although the optimal noise cancelling mode has been the mode A up to now, the continuous counter unit 243 counts the number of times that the optimal mode is the mode B because the optimal mode is changed to the mode B.

However, if the noise state of the external environment varies and the optimal noise cancelling mode returns to the mode A, the continuous counter unit 243 resets a retained counter value.

Subsequently, it is assumed that the optimal-mode determination unit 242 determines that the optimal noise cancelling mode is the mode C after the noise state of the external environment varies. Although the optimal noise cancelling mode has been the mode A up to now, the continuous counter unit 243 counts the number of times that the optimal mode is the mode C because the optimal mode is changed to the mode C. If the optimal-mode determination unit 242 continuously determines that the optimal noise cancelling mode is the mode C three times, the noise state of the external environment is determined to be completely varied. As a result, the continuous counter unit 243 generates an optimal-mode control signal for changing the noise cancelling mode to the mode C, and outputs the optimal-mode control signal to the noise cancelling unit 232.

The configuration of the noise analysis unit 231 according to the third embodiment of the present invention has been described above. Here, an example of the configuration of the noise analysis unit 231 according to the third embodiment of the present invention has been described, but, of course, it is possible to apply the noise analysis unit 31 according to the first embodiment of the present invention or the noise analysis unit 131 according to the second embodiment of the present invention described above.

As described above, the signal processing unit 230 according to the third embodiment of the present invention executes the noise cancelling process by two noise cancelling units (DSPs). At this time, one noise cancelling unit constantly operates and the other noise cancelling unit is started only when the noise cancelling mode is changed. The signal processing unit 230 according to the third embodiment of the present invention can suppress power consumption by configuring the noise cancelling units (DSPs) as described above.

<4. Fourth Embodiment>

[4-1. Configuration of Signal Processing Unit]

The configuration including one DSP for executing a process of analyzing a noise signal and the configuration including two DSPs for executing a noise cancelling process of generating a noise cancelling signal have been described in the above-described first to third embodiments of the present invention. As described above, it is possible to use a BPF in the determination of the optimal noise cancelling mode. The optimal noise cancelling mode is determined by observing an output passing through the BPF for the noise signal obtained from a sound collected by the microphone 2 and employing an observation result in each frequency band.

Here, a configuration for reducing the number of resources by applying the signal processing unit 230 according to the above-described third embodiment of the present invention and executing a process of analyzing a noise signal and a noise cancelling process by one DSP will be described in the fourth embodiment of the present invention.

Figure 19:
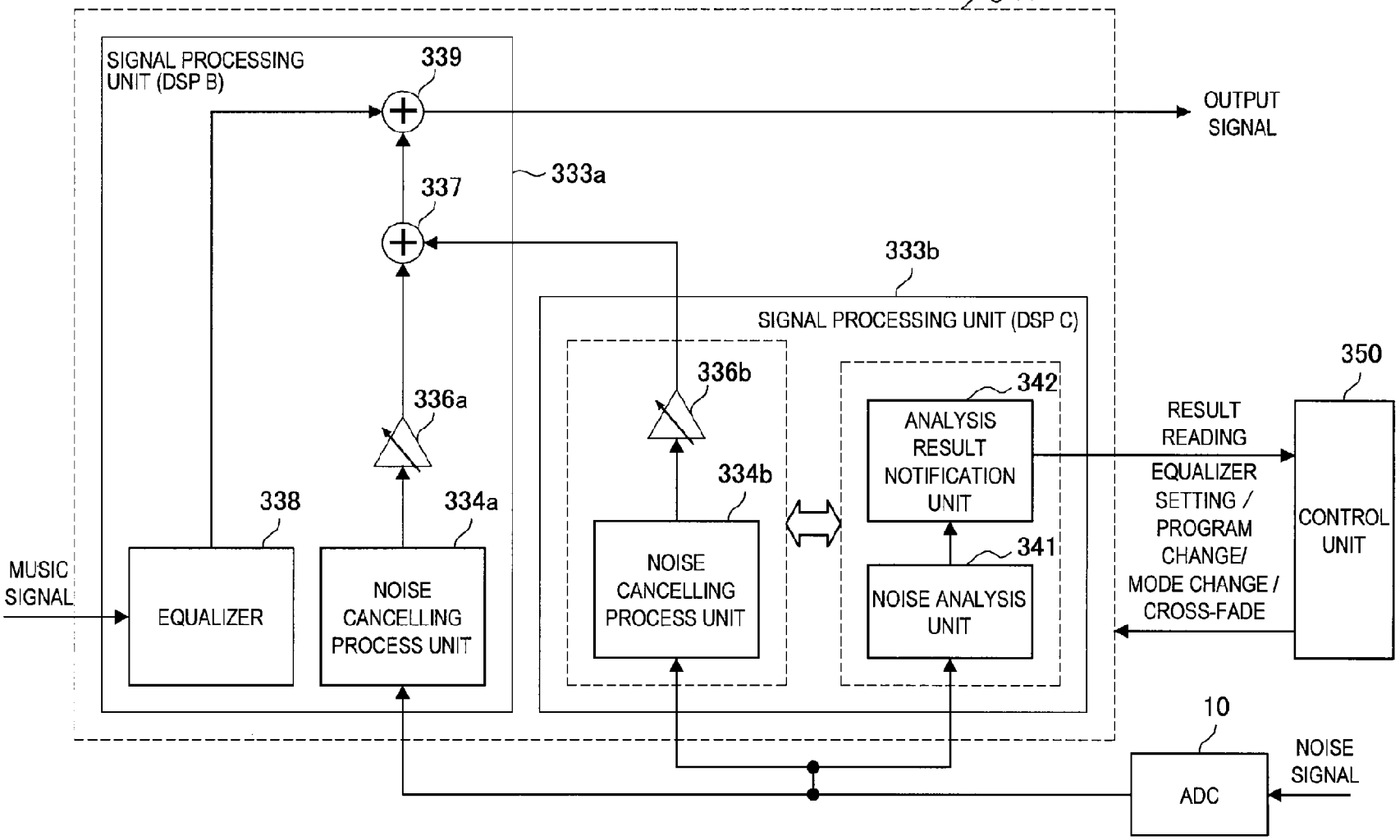
FIG. 19 is an illustrative diagram showing a configuration of a signal processing unit 330 according to a fourth embodiment of the present invention.

FIG. 19 is an illustrative diagram showing a configuration of a signal processing unit 330 according to the fourth embodiment of the present invention. In FIG. 19, an ADC 10 and a control unit 350 are also shown in addition to the signal processing unit 330. Hereinafter, the configuration of the signal processing unit 330 according to the fourth embodiment of the present invention will be described using FIG. 19.

As shown in FIG. 19, the signal processing unit 330 according to the fourth embodiment of the present invention includes signal processing units 333*a* and 333*b*. The signal processing unit 333*a* includes a noise cancelling process unit 334*a*, a multiplication unit 336*a*, addition units 337 and 339, and an equalizer 338. The signal processing unit 333*b* includes a noise cancelling process unit 334*b*, a multiplication unit 336*b*, a noise analysis unit 341, and an analysis result notification unit 342.

As shown in FIG. 19, the signal processing unit 333*a* is designated as a DSP B and the signal processing unit 333*b* is designated as a DSP C. The signal processing unit 333*b* is configured so that a configuration including the noise cancelling process unit 334*b* and the multiplication unit 336*b* and a configuration including the noise analysis unit 341 and the analysis result notification unit 342 are reconfigurable by the control unit 350. When a process of analyzing a noise signal is executed, the signal processing unit 333*b* is configured to include the noise analysis unit 341 and the analysis result notification unit 342. When the noise cancelling mode is switched, the signal processing unit 333*b* is configured to include the noise cancelling process unit 334*b* and the multiplication unit 336*b*.

Like the noise analysis unit 31, the noise analysis unit 341 executes a process of analyzing a noise signal converted into a digital signal by the ADC 10. The analysis process of the noise analysis unit 341 is constantly executed at a predetermined interval while a full automatic optimal-mode selection function is valid. The noise analysis unit 341 executes a frequency characteristic analysis of a noise signal by performing band dividing of the noise signal or the like, for example, based on an FFT or a BPF. The noise analysis unit 341 selects one optimal noise cancelling mode as a result of frequency characteristic analysis of the noise signal.

The analysis result notification unit 342 notifies the control unit 350 of a result of the process of analyzing the noise signal by the noise analysis unit 341. Information reported to the control unit 350 by the analysis result notification unit 342 regards information of an optimal noise cancelling mode selected by the noise analysis unit 341. If the control unit 350 receives the information regarding the optimal noise cancelling mode reported from the analysis result notification unit 342, the control unit 350 determines whether or not to reconfigure the signal processing unit 333*b* on the basis of the received information.

Like the noise cancelling process units 33*a* and 33*b*, each of the noise cancelling process units 334*a* and 334*b* generates a signal for eliminating external noise reaching the ear of the user wearing the headphones 1 by performing a predetermined digital filtering operation on the noise signal converted into the digital signal by the ADC 10. The noise cancelling process units 334*a* and 334*b* may be constituted, for example, by FIR filters.

Like the multiplication units 336*a* and 336*b*, the multiplication units 336*a* and 336*b* respectively multiply outputs of the noise cancelling process units 334*a* and 334*b* by time-variant coefficients (gains) in response to an instruction from the control unit 350. Data multiplied by the multiplication units 336*a* and 336*b* is output to the addition unit 337.

The addition unit 337 adds outputs of the multiplication units 336*a* and 336*b* and outputs an addition result to the addition unit 339. Like the equalizer 38, the equalizer 338 executes an equalization process for a music signal transmitted from the music reproduction device or the like connected to the headphones 1. For example, the control unit 350 can estimate a spectrum of the remaining noise after the noise cancelling effect is obtained, and decide an equalizer setting to execute an equalization process to increase a level of a music signal in reinforcement in a band in which the remaining noise is strong. The addition unit 339 adds the output of the addition unit 337 to the output of the equalizer 338 and outputs an addition result. An output of the addition unit 339 is output to the DAC 40 and is converted into a digital signal by the DAC 40.

An example in which the noise cancelling process of the noise cancelling process unit 334*a* and the equalization process of the equalizer 338 are executed by the same DSP is shown in FIG. 19, but the present invention is not limited to the above-described example. The noise cancelling process of the noise cancelling process unit 334*a* and the equalization process of the equalizer 338 may be executed by separate DSPs.

The control unit 350 is constituted, for example, by a microcomputer, a microcontroller, or the like, and outputs various instructions to the signal processing unit 333*b*. Various instructions to the signal processing unit 333*b* are an equalizer setting for the equalizer 338, reconfiguration of the signal processing unit 333*b*, and a change instruction of a noise cancelling mode, a start instruction of a cross-fade process, and the like. If the signal processing unit 333*b* is implemented by software, the control unit 350 may reconfigure a program for the signal processing unit 333*b*.

The configuration of the signal processing unit 330 according to the fourth embodiment of the present invention has been described above. Next, an operation of the signal processing unit 330 according to the fourth embodiment of the present invention will be described.

[4-2. Operation of Signal Processing Unit]

Figure 20:
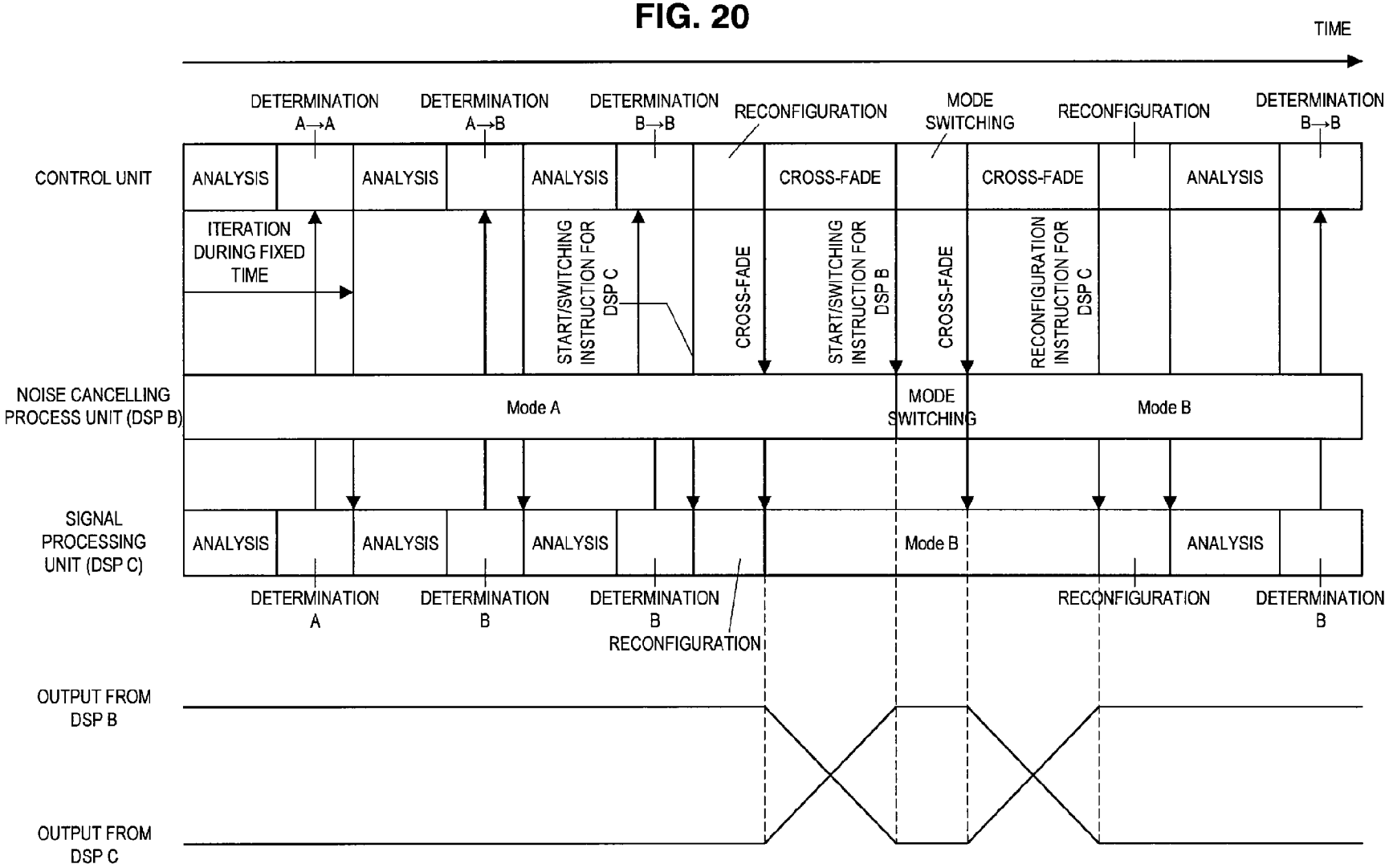
FIG. 20 is an illustrative diagram showing a transition state of the noise cancelling mode in the signal processing unit 330 according to the fourth embodiment of the present invention in a sequence diagram.

FIG. 20 is an illustrative diagram showing a transition state of the noise cancelling mode in the signal processing unit 330 according to the fourth embodiment of the present invention in a sequence diagram. Hereinafter, an operation of the signal processing unit 330 according to the fourth embodiment of the present invention will be described using FIG. 20.

For normal time, that is, when the noise cancelling mode is not switched, a noise signal analysis instruction is periodically output from the control unit 350 to the signal processing unit 333*b* (DSP C). The signal processing unit 333*b* receiving the noise signal analysis instruction from the control unit 350 executes a process of analyzing the noise signal by the noise analysis unit 341. If the noise analysis unit 341 executes the process of analyzing the noise signal, an analysis result is reported from the analysis result notification unit 342 to the control unit 350.

If a noise cancelling mode different from a current noise cancelling mode is continuously reported from the analysis result notification unit 342 a predetermined number of times, the control unit 350 executes a process of switching the noise cancelling mode. When the noise cancelling mode is switched, the control unit 350 first instructs the signal processing unit 333*b* (DSP C) to reconfigure a configuration. The signal processing unit 333*b* (DSP C) receiving the instruction from the control unit 350 is reconfigured from the configuration including the noise analysis unit 341 and the analysis result notification unit 342 to the configuration including the noise cancelling process unit 334*b* and the multiplication unit 336*b*.

If the configuration of the signal processing unit 333*b* is reconfigured, the control unit 350 outputs an instruction for switching the noise cancelling mode to the signal processing unit 333*b*. The signal processing unit 333*b* receiving the instruction for switching the noise cancelling mode switches the noise cancelling process unit 334*b* to a mode of the received instruction. If the noise cancelling mode of the noise cancelling process unit 334*b* is switched, the control unit 350 executes a cross-fade process between the noise cancelling process unit 334*a* and the noise cancelling process unit 334*b*.

If the cross-fade process between the noise cancelling process unit 334*a* and the noise cancelling process unit 334*b* is completed, the control unit 350 outputs an instruction for switching the noise cancelling mode to the signal processing unit 333*a*. The signal processing unit 333*a* receiving the instruction for switching the noise cancelling mode switches the noise cancelling process unit 334*a* to a mode of the received instruction. If the noise cancelling mode of the noise cancelling process unit 334*a* is switched, the control unit 350 executes a cross-fade process between the noise cancelling process unit 334*b* and the noise cancelling process unit 334*a*.

If the cross-fade process between the noise cancelling process unit 334*a* and the noise cancelling process unit 334*b* is completed, a reconfiguration instruction is output from the control unit 350 to the signal processing unit 333*b* (DSP C). The signal processing unit 333*b* (DSP C) receiving the instruction from the control unit 350 is reconfigured from the configuration including the noise cancelling process unit 334*b* and the multiplication unit 336*b* to the configuration including the noise analysis unit 341 and the analysis result notification unit 342.

If the configuration of the signal processing unit 333*b* is reconfigured, the control unit 350 resumes an operation of periodically outputting the noise signal analysis instruction to the signal processing unit 333*b* (DSP C). The signal processing unit 333*b* receiving the noise signal analysis instruction from the control unit 350 resumes the execution of the noise signal analysis process of the noise analysis unit 341.

The operation of the signal processing unit 330 according to the fourth embodiment of the present invention has been described above. The output of the DSP B and the output of the DSP C are linearly varied and the two outputs intersect at a middle point as shown in FIG. 20, but the variation of the output of the DSP B and the output of the DSP C in the cross-fade process of the present invention is not limited to the above-described example. For example, the timing when the output of the DSP B starts to be varied and the timing when the output of the DSP C starts to be varied may be shifted.

As described above, the signal processing unit 330 according to the fourth embodiment of the present invention executes the noise cancelling process by two signal processing units (DSPs). At this time, the configuration is reconfigured in the case where one signal processing unit is constantly in operation and the other signal processing unit executes the noise signal analysis process and the case where the noise cancelling mode is switched. As compared with the first to third embodiments of the present invention having three or four DSPs, the signal processing unit 330 according to the fourth embodiment of the present invention can reduce the number of resources by configuring the signal processing unit (DSP) as described above.

Incidentally, a coefficient (filter coefficient) is assigned from an outside when the noise cancelling mode is set to the noise cancelling process unit in the above-described first to fourth embodiments of the present invention. A noise cancelling process unit to which the coefficient from the outside is assigned executes the noise cancelling process by writing the assigned coefficient.

Figure 21:
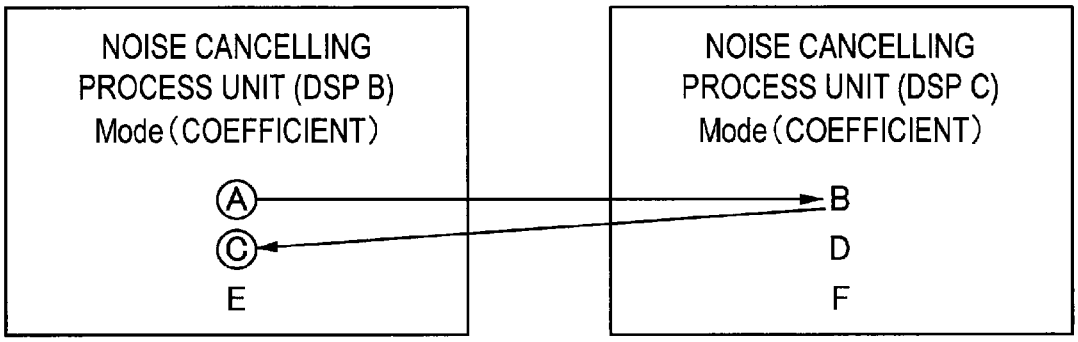
FIG. 21 is an illustrative diagram conceptually showing a technique of iterating the mode transition until an optimal noise cancelling mode is reached.

However, the present invention is not limited to the above-described example. For example, coefficients may be provided in advance inside two DSPs that execute the noise cancelling process. For example, noise cancelling modes neighboring each other may be alternately provided in the two DSPs that execute the noise cancelling process, and a mode transition may be iterated until an optimal noise cancelling mode is reached. FIG. 21 is an illustrative diagram conceptually showing a technique of alternately providing noise cancelling modes neighboring each other in two DSPs and iterating a mode transition until an optimal noise cancelling mode is reached.

However, this technique is not preferable because more time is taken until the optimal noise cancelling mode is reached when the number of noise cancelling modes is increased.

Figure 22:
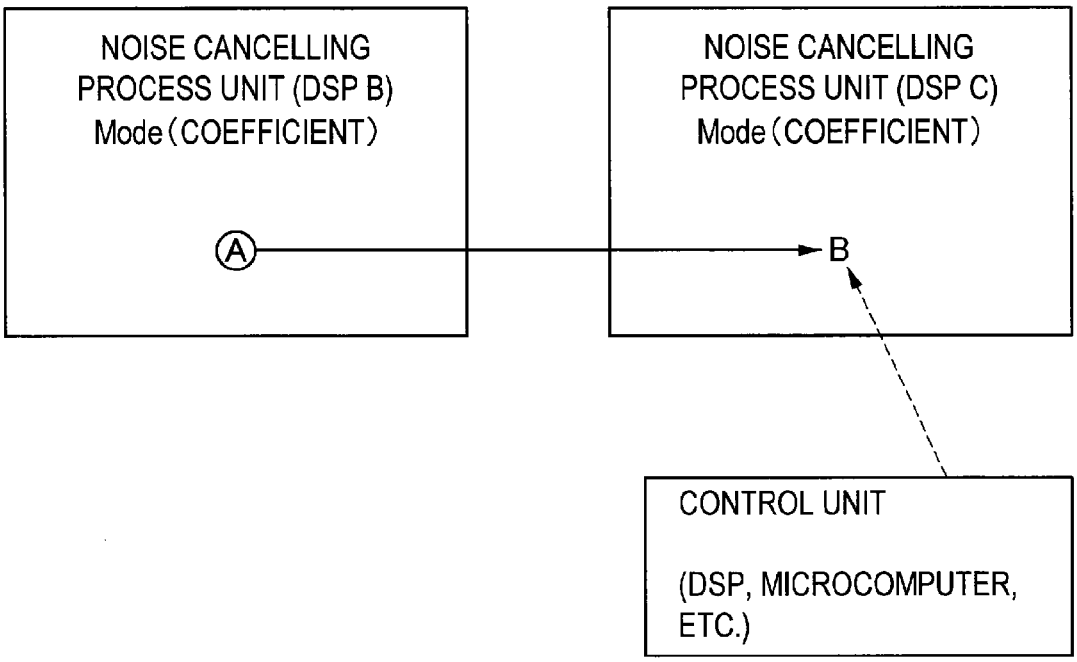
FIG. 22 is an illustrative diagram conceptually showing a technique of assigning a coefficient of the optimal noise cancelling mode to a DSP.

Another technique assigns a coefficient of the optimal noise cancelling mode from an external DSP, a microcomputer, a microprocessor, or the like to a DSP before the mode transition is executed. FIG. 22 is an illustrative diagram conceptually showing a technique of assigning a coefficient of the optimal noise cancelling mode from an external DSP, a microcomputer, a microprocessor, or the like to a DSP. It is possible to provide noise cancelling modes exceeding a permissible amount of a DSP for executing the noise cancelling process using the above-described technique. Speaking in the extreme, if this technique is adopted, it is preferable that the permissible amount of the DSP for executing the noise cancelling process retain a coefficient for one mode. Of course, the DSP for executing the noise cancelling process may have a permissible amount capable of retaining coefficients of two or more modes. In this case, a well-used noise cancelling mode is retained inside the DSP with a high probability, leading to the speed-up and simplification of the noise cancelling process.

Figure 23:
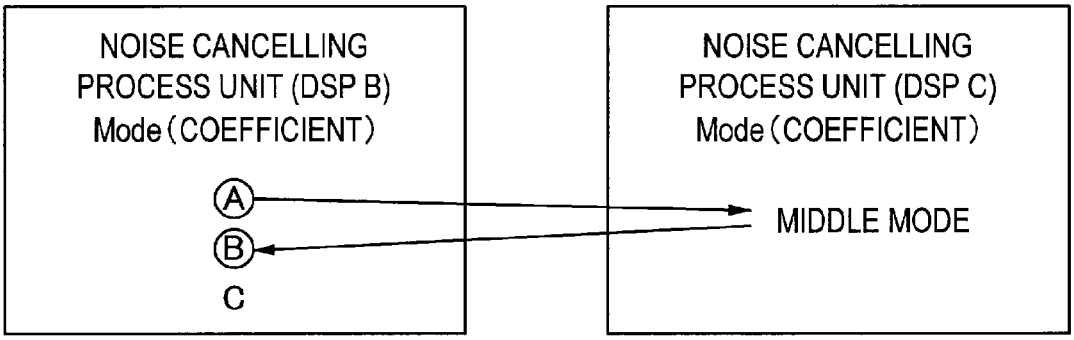
FIG. 23 is an illustrative diagram conceptually showing a technique of pre-setting a mode dedicated for a transition time in a sub-DSP.

In the case of a configuration that causes two DSPs to move back and forth when the noise cancelling mode is switched as in the signal processing unit 230 according to the third embodiment of the present invention or the signal processing unit 330 according to the fourth embodiment of the present invention described above, the DSP (DSP C) to be only temporarily used may preset a dedicated mode for a transition time, not a mode of a transition destination. The dedicated mode for the transition time is a mode including a filter coefficient having a certain degree of noise cancellation capability no matter what frequency characteristic a noise signal has. FIG. 23 is an illustrative diagram conceptually showing a technique of presetting the dedicated mode for the transition time to the sub-DSP (DSP C). As described above, the dedicated mode for the transition time is preset to the sub-DSP to be only temporarily used, leading to the speed-up and simplification of the noise cancelling process without having to set a mode of the transition destination to the sub-DSP for the mode transition time.

In the case of the configuration that causes two DSPs to move back and forth when the noise cancelling mode is switched, the mode after the transition may be set when the sub-DSP is set to a sleep mode having low power consumption or a power saving mode after the noise cancelling mode is switched. During the next mode transition, the mode transition may be executed by omitting a process for switching to a mode of the transition destination for the sub-DSP.

In the first to fourth embodiments of the present invention, a process of switching the noise cancelling mode is basically completed inside the signal processing units 30, 130, 230, and 330. However, the present invention is not limited to the above-described example. The process of switching the noise cancelling mode may be executed by control of a DSP, a microcomputer, a microcontroller, or the like provided separately from the signal processing units. For example, it is possible to present whether or not the noise cancelling process is executed to the user by lighting/flickering a character or a light if the current noise cancelling mode is recognized by a microcomputer that controls the entire operation of the headphones 1. It is possible to stop the noise cancelling process by an operation (for example, power off) other than the noise cancelling process if the noise cancelling process is controlled by the microcomputer that controls the entire operation of the headphones 1.

Figure 24:
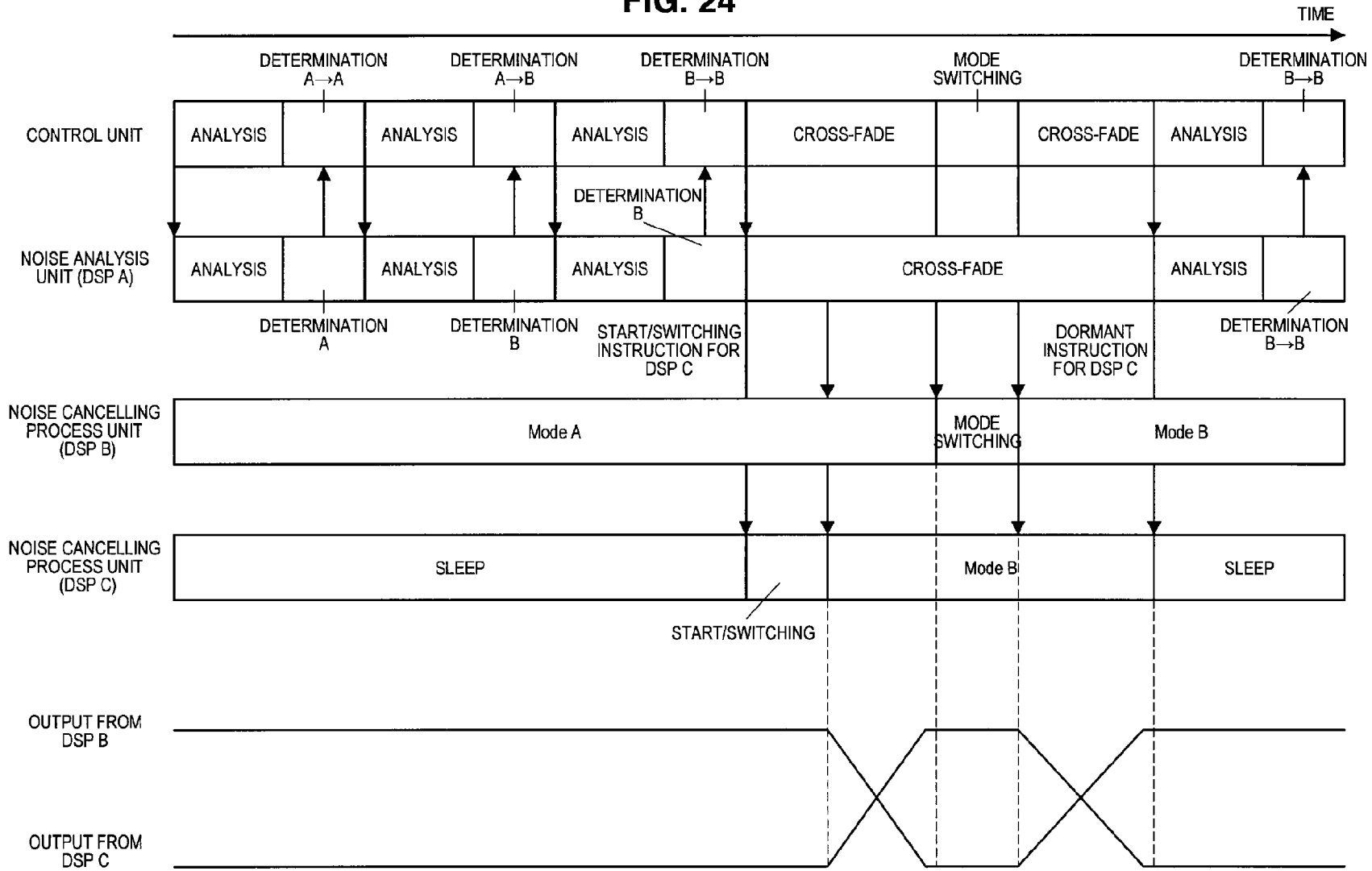
FIG. 24 is an illustrative diagram showing a flow in which a microcomputer operates in a sequence diagram.

FIG. 24 is an illustrative diagram showing a flow in which a control unit (microcomputer) executes a noise signal analysis instruction, a cross-fade process, and a dormant instruction for a sub-DSP in a sequence diagram. FIG. 24 shows the case where the cross-fade process between two DSPs shown in FIG. 16 is executed by control of the control unit. In the flow of the process shown in FIG. 24, an example in which the cross-fade process is started on the condition that a mode different from the current noise cancelling mode is continuously determined to be an optimal mode twice as a result of noise analysis by the noise analysis unit is shown.

The flow of the noise signal analysis instruction, the cross-fade process, and the dormant instruction for the sub-DSP shown in FIG. 24 will be described. The control unit instructs the noise analysis unit (DSP A) to execute the noise signal analysis process at a predetermined interval. The noise analysis unit receiving the instruction from the control unit executes the noise signal analysis process in response to the instruction, determines an optimal noise cancelling mode, and returns a determination result to the control unit. If the optimal noise cancelling mode is changed, the control unit outputs a start instruction to the noise cancelling process unit (DSP C) during dormancy. Also, the control unit instructs the noise cancelling process unit (DSP C) to perform switching to a new noise cancelling mode along with the start instruction.

If the noise cancelling process unit (DSP C) completes the switching to the new noise cancelling mode, the control unit makes an instruction for starting the cross-fade process. If the cross-fade process is completed and the output is permutated, the noise cancelling process unit (DSP B) is subsequently instructed to perform switching to the new noise cancelling mode. If the noise cancelling process unit (DSP B) completes the switching to the new noise cancelling mode, the control unit makes an instruction for starting the cross-fade process. If the cross-fade process is completed and the output is permutated, the control unit subsequently outputs a dormant instruction to the noise cancelling process unit (DSP C) and instructs the noise analysis unit (DSP A) to execute the noise signal analysis process.

<5. Fifth Embodiment>

[5-1. Configuration of Headphones]

Figure 25:
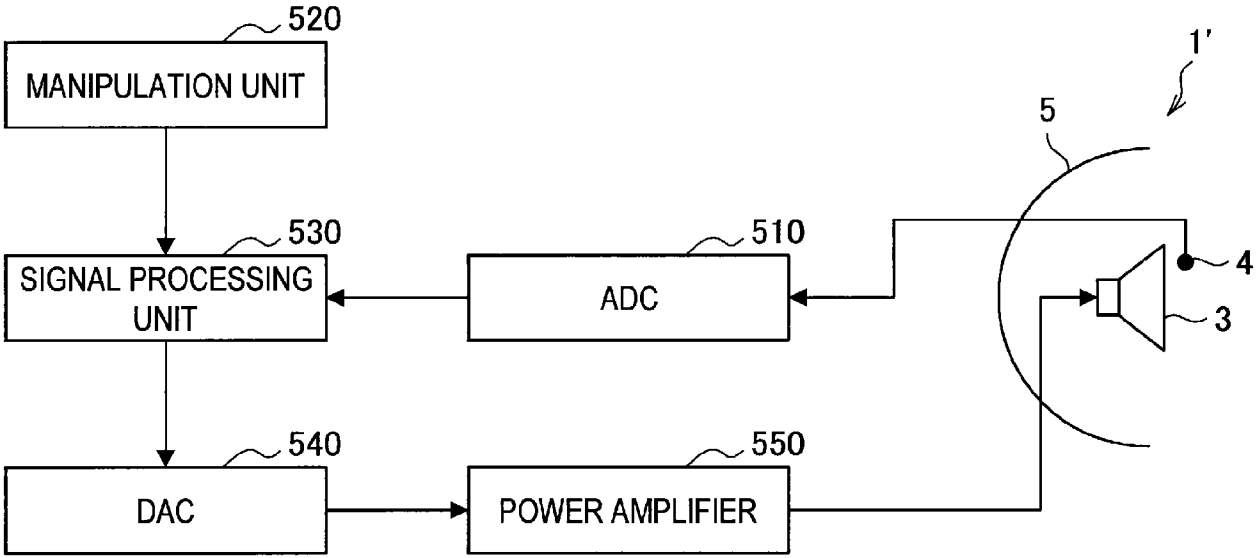
FIG. 25 is an illustrative diagram showing a functional configuration of headphones 1' according to a fifth embodiment of the present invention.

The noise cancelling process based on the feedforward type has been described as a premise in the first to fourth embodiments of the present invention, but the present invention is also applicable to a noise cancelling process based on a feedback type. FIG. 25 is an illustrative diagram showing a functional configuration of headphones 1' according to the fifth embodiment of the present invention including a noise cancelling system that cancels noise by the feedback type.

As shown in FIG. 25, the headphones 1' according to the fifth embodiment of the present invention include a speaker 3, a microphone 4, an ADC 510, a manipulation unit 520, a signal processing unit 530, a DAC 540, and a power amplifier 550.

The microphone 4 is provided inside a housing unit 5 of the headphones 1', and collects a sound of noise inside the housing unit 5. The speaker 3 outputs an audio. In the feedback type, the sound of noise inside the housing unit 5 is collected by the microphone provided inside the housing unit 5 of the headphones 1', and the noise cancelling process is executed for the collected sound. As the cause of noise occurring inside the housing unit 5 of the headphones 1', for example, an external noise sound source is leaked as a sound pressure, for example, from a gap such as an ear pad of the housing unit 5, the housing of the headphones 1' is vibrated by receiving the sound pressure of the noise sound source, and the vibration is transferred to the inside of the housing unit 5. A noise cancelling signal obtained as a result obtained by executing the noise cancelling process is synthesized with an audio signal transferred from the music reproduction device connected to the headphones 1'. If the synthesized signal is output from the speaker 3, a sound from which external noise entering the housing unit 5 is eliminated reaches the ear of the user.

The ADC 510 converts a noise signal obtained as a result of sound collection by the microphone 4 into a digital signal. The noise signal converted into the digital signal by the ADC 510 is output to the signal processing unit 530.

The manipulation unit 520 is designed to receive a manipulation of the user on the headphones 1'. The manipulation of the user on the headphones 1' may be, for example, power on/off of the headphones 1', adjustment of a volume of a sound output from the speaker 3, and on/off of the noise cancelling function. Furthermore, the manipulation of the user on the headphones 1' may be selection of the noise cancelling mode in which the noise cancelling function is valid, on/off of the full automatic optimal-mode selection function, or the like. A signal generated by manipulating the manipulation unit 520 is transferred, for example, to a microcomputer (not shown), and is transferred from the microcomputer to the signal processing unit 530, if necessary.

The signal processing unit 530 processes the noise signal converted into the digital signal by the ADC 510. The signal processing unit 530 analyzes the noise signal and generates a noise cancelling signal that eliminates the noise signal. An audio signal transferred from the music reproduction device connected to the headphones 1 is also input to the signal processing unit 530. The signal processing unit 530 also processes the input audio signal. The signal processing unit 530 is constituted, for example, by a plurality of DSPs.

The DAC 540 converts a signal output from the signal processing unit 530 into an analog signal. The signal converted into the analog signal by the DAC 540 is output to the power amplifier 550.

The power amplifier 550 amplifies the signal converted into the analog signal by the DAC 540 and outputs the amplified signal. The signal amplified by the power amplifier 550 is output to the speaker 3. The speaker 3 is configured to output an audio signaled by a vibration plate (not shown) in response to the signal supplied from the power amplifier 550.

The functional configuration of the headphones 1' according to the fifth embodiment of the present invention has been described above using FIG. 25. The signal processing units 30, 130, 230, and 330 according to the above-described first to fourth embodiments of the present invention are applicable to the signal processing unit 530 shown in FIG. 25. Accordingly, it is possible to switch the mode without stopping a noise cancelling process or a music signal output when an optimal noise cancelling mode is switched even in the noise cancelling process based on the feedback type. Because the headphones 1' according to the fifth embodiment of the present invention cancel noise by the feedback type, it is preferable that a coefficient (filter coefficient) used in the noise cancelling process be different from that of the feedforward type.

<6. Others>

In the above-described first to fifth embodiments of the present invention, a process of switching the noise cancelling mode is implemented by providing two DSPs inside the signal processing units 30, 130, 230, 330, and 530. However, two DSPs may not be provided inside the signal processing unit due to limitations of a device. In this case, it is not possible to implement a full automatic optimal-mode selection function. However, if a DSP that executes a noise signal analysis process and a DSP that generates a noise cancelling signal can be provided, it is possible to detect a change of the optimal noise cancelling mode.

Accordingly, it is possible to notify the user of the change of the optimal noise cancelling mode by beep sound generation, character display, or the like even when two DSPs may not be provided inside the signal processing unit. That is, it is possible to analyze a background noise signal during execution of the noise cancelling process and notify the user of the change of the optimal cancelling mode.

If the notification is performed every time the optimal noise cancelling mode is changed, the notification may annoy the user. Accordingly, a notification function based on the beep sound generation, the character display, or the like may be validated or invalidated by a manipulation of the user. A notification timing based on the notification function may be limited to the case where the current mode is not the optimal noise cancelling mode or the case where the current mode is the optimal noise cancelling mode.

<7. Summary>

According to the first to fifth embodiments of the present invention as described above, a noise sound of an external environment collected by the microphone is analyzed while the full automatic optimal-mode selection function is executed, and one optimal noise cancelling mode is selected on the basis of an analysis result. If one optimal noise cancelling mode is selected, the headphones according to the first to fifth embodiments of the present invention are transitioned to the selected noise cancelling mode without stopping an audio output and a noise cancelling process. Upon switching to the selected noise cancelling mode, outputs from two noise cancelling process units are cross-faded. The headphones according to the first to fifth embodiments of the present invention can provide the user with a comfortable acoustic environment by switching the noise cancelling mode as described above.

According to the second embodiment of the present invention, the process of generating the noise cancelling signal and the equalizer process for the music signal can be executed by the same DSP even while the full automatic optimal-mode selection function is executed.

According to the third embodiment of the present invention, the noise cancelling process may be executed by two noise cancelling units (DSPs). At this time, one noise cancelling unit constantly operates and the other noise cancelling unit is started only when the noise cancelling mode is changed. Thereby, according to the third embodiment of the present invention, it is possible to suppress power consumption in the noise cancelling process.

According to the fourth embodiment of the present invention, the noise cancelling process is executed by two signal processing units (DSPs). At this time, the configuration is reconfigured in the case where one signal processing unit is constantly in operation and the other signal processing unit executes the noise signal analysis process and the case where the noise cancelling mode is switched. Consequently, it is possible to reduce the number of resources by configuring the signal processing unit (DSP) as described above according to the fourth embodiment of the present invention as compared with the first to third embodiments of the present invention having three or four DSPs.

According to the fifth embodiment of the present invention, it is possible to make a transition to an automatically selected noise cancelling mode even when noise is eliminated by the feedback type as well as the feedforward type. It is possible to make the transition to the automatically selected noise cancelling mode without stopping an audio output and a noise cancelling process. Consequently, the headphones according to the fifth embodiment of the present invention can provide the user with a comfortable acoustic environment.

The preferred embodiments of the present invention have been described above with reference to the accompanying drawings, whilst the present invention is not limited to the above examples, of course. A person skilled in the art may find various alternations and modifications within the scope of the appended claims, and it should be understood that they will naturally come under the technical scope of the present invention.

For example, outputs of two noise cancelling process units are cross-faded if an optimal noise cancelling mode is changed in each embodiment described above, but the present invention is not limited to the above-described example. If the optimal noise cancelling mode is changed, for example, a synthesis rate of outputs of three noise cancelling process units may be temporally varied and a noise cancelling process based on the optimal noise cancelling mode may be finally executed.

An example of circumaural headphones for an illustration is shown in a diagram used in the description of each embodiment described above, but the present invention is not limited to the above-described example. Of course, the present invention is applicable to noise cancelling headphones such as an on-ear type or an in-ear type (earphone) as well as the circumaural headphones.

In the headphones according to each embodiment described above, the noise analysis process and the noise cancelling process may be executed by only hardware or software. In the headphones according to each embodiment described above, the noise analysis process and the noise cancelling process may be executed by a combination of hardware and software. If the noise cancelling process is executed by the combination of hardware and software, for example, the headphones may be configured so that the noise analysis process is executed by software and the noise cancelling process is executed by hardware.

The present invention is applicable to a signal processing device and a signal processing method, and particularly to a signal processing device and a signal processing method that provide a listener with a comfortable acoustic environment by eliminating external noise.

REFERENCE SIGNS LIST 1, 1' Headphones
2, 4 Microphone

3 Speaker
5 Housing unit
30 Signal processing unit
31 Noise analysis unit
32 Noise cancelling unit
33*a*, 33*b* Noise cancelling process unit
35 Cross-fade unit
36*a*, 36*b* Multiplication unit
37 Addition unit
38 Equalizer
39 Addition unit
130 Signal processing unit
131 Noise analysis unit
132 Noise cancelling unit
133*a*, 133*b* Noise cancelling unit
135 Cross-fade unit
136*a*, 136*b* Multiplication unit
137 Addition unit
142 Noise cancelling process unit
144 Equalizer
146 Addition unit
230 Signal processing unit
231 Noise analysis unit
232, 233*a*, 233*b* Noise cancelling unit
234*a*, 234*b* Noise cancelling process unit
236*a*, 236*b* Multiplication unit
237 Addition unit
238 Equalizer
239 Addition unit
330 Signal processing unit
333*a*, 333*b* Signal processing unit
334*a*, 334*b* Noise cancelling process unit
336*a*, 336*b* Multiplication unit
337 Addition unit
338 Equalizer
339 Addition unit

The invention claimed is:

1. A signal processing device comprising:

a noise analysis unit for analyzing a frequency component of a noise signal, obtained by converting a collected sound into an electrical signal, over time and outputting an analysis result that changes over time according to changes over time in the noise signal;

a plurality of filtering units each for carrying out a different fixed predetermined filtering operation on the noise signal, each corresponding to an analysis result that may be output by the noise analysis unit; and an output control unit for temporally varying outputs of the plurality of filtering units according to a change in the analysis result of the noise analysis unit, wherein in response to determining that, based on the change in the analysis result of the noise analysis unit, one filtering unit is to start performing its predetermined filtering operation on the noise signal, the predetermined filtering operation of the one filtering unit including characteristics different from those of other filtering units that are carrying out predetermined filtering operations on the noise signal at the time the change in the analysis result occurs, the output control unit temporally varies the outputs of the other filtering units and the one filtering unit according to the change in the analysis result of the noise analysis unit to switch from the output of the other filtering units to the output of the one filtering unit.

2. The signal processing device according to claim 1, wherein the characteristics of the other filtering units are set to be the same as those of the one filtering unit when an output of the output control unit is switched from the output of the other filtering units to the output of the one filtering unit.

3. The signal processing device according to claim 1, wherein the output control unit starts to switch the output from the other filtering units to the one filtering unit if the noise analysis unit makes a predetermined number of continuous determinations that a filtering operation by characteristics different from current characteristics is preferable as the analysis result of the noise analysis unit.

4. The signal processing device according to claim 1, further comprising:

an equalizer unit for executing an equalization process for an audio signal on the basis of the analysis result of the noise analysis unit and outputting an execution result, wherein an output of the equalizer unit is superimposed on an output of the output control unit.

5. The signal processing device according to claim 4, comprising:

a signal processing unit including the filtering unit and the equalizer unit.

6. The signal processing device according to claim 1, wherein one main filtering unit of the plurality of filtering units constantly operates, and the other filtering units operate only when the analysis result of the noise analysis unit changes and otherwise do not operate.

7. The signal processing device according to claim 1, comprising:

a signal processing unit, which includes the noise analysis unit when the noise signal is analyzed, includes the one filtering unit when a predetermined filtering operation is carried out on the noise signal, and is configured so that the noise analysis unit and the filtering unit are switchable.

8. The signal processing device according to claim 1, wherein the one filtering unit starts a predetermined filtering operation by characteristics different from those of the other filtering units when the analysis result of the noise analysis unit changes and the same analysis result is continuously generated a plurality of times after the change.

9. A signal processing method comprising:

a noise analysis step of analyzing a frequency component of a noise signal, obtained by converting a collected sound into an electrical signal, over time and outputting an analysis result that changes over time according to changes over time in the noise signal;

a first filtering step of, in response to determining that the analysis result output by the noise analysis step at a time is a first analysis result, carrying out a first predetermined filtering operation on the noise signal on the basis of the first analysis result;

a second filtering step of, in response to determining that the analysis result output by the noise analysis step at a time is a second analysis result, carrying out a second predetermined filtering operation on the noise signal by characteristics different from those of the first filtering step on the basis of the second analysis result; and an output control step of, in response to detecting, at a time that the first predetermined filtering operation is being performed on the noise signal, a change in the analysis result of the noise analysis step from the first analysis result to the second analysis result, switching from output of the first filtering step to output of the second filtering step at least in part by triggering performance of the second filtering step and temporally varying output of the first filtering step and the second filtering step until ceasing performance of the first filtering step.

10. At least one non-transitory computer-readable storage medium having encoded thereon executable instructions that, when executed by at least one processor, cause the at least one processor to carry out a method comprising:

a noise analysis step of analyzing a frequency component of a noise signal, obtained by converting a collected sound into an electrical signal, over time and outputting an analysis result that changes over time according to changes over time in the noise signal;

a first filtering step of, in response to determining that the analysis result output by the noise analysis step at a time is a first analysis result, carrying out a first predetermined filtering operation on the noise signal on the basis of the first analysis result;

a second filtering step of, in response to determining that the analysis result output by the noise analysis step at a time is a second analysis result, carrying out a second predetermined filtering operation on the noise signal by characteristics different from those of the first filtering step on the basis of the second analysis result; and an output control step of, in response to detecting, at a time that the first predetermined filtering operation is being performed on the noise signal, a change in the analysis result of the noise analysis step from the first analysis result to the second analysis result, switching from output of the first filtering step to output of the second filtering step at least in part by triggering performance of the second filtering step and temporally varying output of the first filtering step and the second filtering step until ceasing performance of the first filtering step.

* * * * *